US008346141B2

(12) United States Patent
Takano

(10) Patent No.: US 8,346,141 B2
(45) Date of Patent: Jan. 1, 2013

(54) IMAGE FORMING APPARATUS AND IMAGE FORMING METHOD

(75) Inventor: Hidehiro Takano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 297 days.

(21) Appl. No.: 12/893,314

(22) Filed: Sep. 29, 2010

(65) Prior Publication Data

US 2011/0129265 A1 Jun. 2, 2011

(30) Foreign Application Priority Data

Nov. 27, 2009 (JP) ..... 2009-269940

(51) Int. Cl.
*G03G 15/01* (2006.01)

(52) U.S. Cl. ..... 399/304; 399/305

(58) Field of Classification Search ..... 399/304, 399/305, 397, 400
See application file for complete search history.

(56) References Cited

U.S. PATENT DOCUMENTS 5,081,506 A * 1/1992 Borostyan ..... 399/305
6,163,676 A 12/2000 Levanon et al.
8,229,337 B2 * 7/2012 Nagai et al. ..... 399/304
2009/0190981 A1 7/2009 Tanaka

FOREIGN PATENT DOCUMENTS

JP 2000-508280 T 7/2000
JP 2009-205131 A 9/2009
WO WO-97/09262 A1 3/1997

* cited by examiner

*Primary Examiner* — Hoang Ngo
(74) *Attorney, Agent, or Firm* — Global IP Counselors, LLP

(57) ABSTRACT

An image forming apparatus includes: an image carrier; a transfer roller that has a gripping member that grips a transfer medium; and a transfer medium transport section that has a transfer medium transport surface that sucks the transfer medium upward in a vertical direction and a contact member that contact with the transfer medium, wherein a first position where the transfer medium starts to be sucked, a second position where the transfer medium is released from the gripping member, and a third position where the transfer medium is separated from the image carrier are disposed at positions having the relationship of L<L1+L2, wherein L is the distance between the third position and the first position, L1 is the distance between the third position and the second position, and L2 is the distance between the second position and the first position.

8 Claims, 11 Drawing Sheets

IMAGE FORMING APPARATUS AND IMAGE FORMING METHOD

BACKGROUND

1. Technical Field

The present invention relates to an image forming apparatus and an image forming method, which perform transfer in a state where a transfer medium is gripped.

2. Related Art

In the past, with respect to an image forming apparatus, an image forming apparatus has been proposed which uses a transfer roller having a transfer medium gripping member which grips a leading end portion of a transfer medium (refer to, for example, JP-T-2000-508280). In the image forming apparatus described in JP-T-2000-508280, in a state where the leading end portion of the transfer medium is gripped by the transfer medium gripping member, the transfer medium passes through a transfer nip portion by rotation of the transfer roller, whereby an image of an image carrier is transferred to the transfer medium. According to this image forming apparatus, since the leading end portion of the transfer medium is gripped by the transfer medium gripping member, the transfer medium is reliably peeled from the image carrier after the transfer.

On the other hand, an image forming apparatus is proposed in which a transfer medium passes through a transfer nip portion by rotation of a transfer roller, whereby an image of an image carrier is transferred to the transfer medium, and if a leading end portion of the transfer medium passes through the transfer nip portion, the transfer medium is peeled from the image carrier by an air flow generation device, and thereafter, the transfer medium is attracted upward in a vertical direction and moves in a state where a transfer image surface thereof faces downward in a vertical direction, thereby being transported toward a fixing section by a transfer medium transport belt of a transfer medium transport section (refer to, for example, JP-A-2009-205131).

Here, in order to improve a peel property of the transfer medium from the image carrier after transfer, consideration can be given to applying the technology of gripping the leading end portion of the transfer medium, as described in JP-T-2000-508280, to the image forming apparatus described in JP-A-2009-205131. In this case, since the gripping of the leading end portion of the transfer medium is released before the transfer medium transport section, a nip portion end position in a transfer medium movement direction of the transfer nip portion, a transfer medium releasing position, and a transfer medium transport section starting position of the transfer medium transport belt, where the leading end of the transfer medium first comes into contact with it, are disposed to form a virtual approximate triangle. Then, the transfer medium which has passed through the transfer nip portion is moved in a movement pathway which approximately follows two sides of the virtual approximate triangle by a driving force at the transfer nip portion.

However, since the gripping of the transfer medium is released before the leading end portion of the transfer medium reaches the transfer medium transport belt, after the release of the gripping of the transfer medium, the transfer medium needs to be moved from the transfer medium releasing position up to the transfer medium transport section starting position with use of the middle portion of the transfer medium by the driving force at the transfer nip portion. At this time, since the transfer medium moves upward in a vertical direction, a position of the transfer medium becomes unstable. In particular, if a difference in velocity is present between a movement velocity of the transfer medium at the transfer medium transport belt and a movement velocity of the transfer medium at the transfer nip portion, a position of the transfer medium at the time of movement becomes more unstable. Therefore, there is a danger that the transfer image surface of the transfer medium which has passed through the transfer nip portion comes into contact with a member of the image forming apparatus, which is located vertically below the movement pathway of the transfer medium, so that the transferred image is disturbed. Also, as described above, since a position of the transfer medium becomes unstable, so that a position of paper at an outlet of the transfer nip portion cannot be maintained, there is a danger that the transfer image surface of the transfer medium comes into contact with the image carrier, so that displacement of the image occurs. That is, with only simple application of the transfer medium gripping technology described in JP-T-2000-508280 to the image forming apparatus described in JP-A-2009-205131, it is difficult to obtain an excellent image.

SUMMARY

An advantage of some aspects of the invention is that it provides an image forming apparatus and an image forming method, in which in the case of performing transfer in a state where a transfer medium is gripped, even if a position where a transfer medium is separated from an image carrier, a transfer medium releasing position, and a transfer medium suction start position are disposed to form a virtual approximate triangle, an excellent image can be obtained.

In the image forming apparatus and the image forming method according to the invention, a transfer medium is gripped by a gripping member, an image of an image carrier is transferred to the transfer medium at a transfer nip portion, and after the transfer, the image carrier is separated from the transfer medium. Also, the transfer medium is released at a position where the gripping member releases the transfer medium. Next, the transfer medium is moved toward a transfer medium transport section with use of the middle portion thereof by the driving force of a transfer roller, which is provided at the transfer nip portion. Then, if a leading end of the transfer medium reaches a position where the transfer medium starts to be sucked, the back surface (the reverse side to a transfer image surface) side of the transfer medium attempts to move upward in a vertical direction while the transfer image surface faces downward in a vertical direction. Next, using a transfer medium transport surface of the transfer medium transport section, the transfer medium is sucked upward in a vertical direction at the back surface side with the transfer image surface facing downward in a vertical direction. In this case, a position where the transfer medium is separated from the image carrier, a position where the gripping member releases the transfer medium, and a position where the transfer medium transport section starts to suck the transfer medium are disposed to form a virtual approximate triangle when viewed from the direction perpendicular or approximately perpendicular to a transfer medium movement direction (from the direction parallel or approximately parallel to the axial direction of the transfer roller). Therefore, the transfer medium moves while being bent upward along a side of the virtual approximate triangle, which connects the position where the transfer medium is separated from the image carrier and the position where the gripping member releases the transfer medium and a side of the virtual approximate triangle, which connects the position where the gripping member releases the transfer medium and the position where the transfer medium transport section starts to suck the transfer medium. In this case, when the distance between the position where the transfer medium is separated from the image carrier and the position where the transfer medium transport section starts to suck the transfer medium is L, the distance between the position where the transfer medium is separated from the image carrier and the position where the gripping member releases the transfer medium is L1, and the distance between the position where the gripping member releases the transfer medium and the position where the transfer medium transport section starts to suck the transfer medium is L2, L has the relationship of $L<L1+L2$ with respect to L1 and L2.

Then, if the leading end of the transfer medium reaches the transfer medium suction start position, the transfer medium moves to approximately follow the side of the virtual approximate triangle, which connects the position where the transfer medium is separated from the image carrier and the position where the transfer medium transport section starts to suck the transfer medium. That is, since the transfer medium bent upward attempts to becomes straight, friction occurs between the transfer medium and the transfer medium transport section, so that a position of the transfer medium is changed, thereby becoming unstable. In particular, since the transfer medium is moved by the driving force at the transfer nip portion, if a difference in velocity is present between a movement velocity of the transfer medium at the transfer nip portion and a movement velocity of the transfer medium at the transfer medium transport section, the transfer medium is bent downward in a vertical direction, thereby attempting to move along the movement pathway which approximately follows the remaining one side of the virtual approximate triangle between the position where the transfer medium is separated from the image carrier and the transfer medium suction start position. Therefore, a position of the transfer medium becomes more unstable.

Therefore, even after the leading end of the transfer medium reaches the position where the transfer medium transport section starts to suck the transfer medium, while the transfer medium is moved by the driving force at the transfer nip portion, the back surface of the transfer medium comes into contact with a plurality of contact members of the transfer medium transport section, so that the friction between the transfer medium and the transfer medium transport section is reduced. In particular, if the contact member is a roller member which rotates about a shaft extending in the direction perpendicular or approximately perpendicular to the transfer medium movement direction, as the back surface of the transfer medium is guided by the roller member, the friction between the transfer medium and the transfer medium transport section is more effectively reduced. As a result of this, it becomes possible to suppress changes in the position of the transfer medium and instability of the transfer medium according to the changes. In particular, since the friction between the transfer medium and the transfer medium transport section is reduced, so that changes in position of the transfer medium is suppressed, two sides of the above-mentioned approximate triangle come close to the remaining one side, so that the shape of the approximate triangle becomes a flatter triangular shape. Therefore, the transfer medium can be prevented from coming into contact with a member of the image forming apparatus, such as the image carrier which is disposed vertically below the movement pathway of the transfer medium, and also changes in width of the transfer nip portion can be suppressed. As a result, generation of displacement of the image can be suppressed. In this way, even if the position where the transfer medium is separated from the image carrier, the position where the gripping member releases the transfer medium, and the position where the transfer medium transport section starts to suck the transfer medium are disposed to form a virtual approximate triangle, it becomes possible to realize an image forming apparatus and an image forming method, which allow an excellent image be obtained.

In particular, the portion of the transfer medium gripped by the gripping member is located in a concave portion of the transfer roller, so that the transfer nip portion can be stably formed. In this case, since the gripped portion of the transfer medium is located in the concave portion of the transfer roller, a gripping trace due to the concave portion, which is curved to the transfer image surface side, is formed at the leading end portion of the transfer medium. Then, since the back surface of the transfer medium is guided by the transfer medium transport roller, such a gripping trace is formed at the leading end portion of the transfer medium, so that the transfer medium can be prevented from being wrapped around the transfer medium transport roller. As a result, even if the transfer medium is guided by the transfer medium transport roller, the transfer medium can be moved smoothly.

Also, the transfer medium transport roller is divided into a plurality and disposed in the direction perpendicular or approximately perpendicular to the transfer medium movement direction, so that the transfer medium transport roller can be made small in size and light in weight and can also be easily rotated. Therefore, the guidance of the transfer medium by the transfer medium transport roller can be more evenly performed, so that a position of the transfer medium can be further stabilized.

Further, in a case where as a method of attracting the transfer medium upward in a vertical direction, the transfer medium is sucked upward in a vertical direction by a suction hole provided at the transfer medium transport section, a position of the gripping member of the transfer roller and a position of the suction hole are set to be different from each other in the direction perpendicular or approximately perpendicular to the transfer medium movement direction. As a result of this, the gripping member and the suction hole do not overlap with each other in the transfer medium movement direction. Therefore, as described above, even if the gripping trace due to the concave portion is formed at the leading end portion of the transfer medium, since the gripping trace does not pass the suction hole, suction of the transfer medium by the suction hole of the transfer medium transport section can be more effectively performed and also the transfer medium can be sucked and transported in a stable position.

Further, a plurality of gripping members is disposed at predetermined intervals in the direction perpendicular or approximately perpendicular to the transfer medium movement direction and also the contact member is disposed between the gripping members. As a result of this, since the gripping member and the contact member do not overlap with each other in the transfer medium movement direction, as described above, even if the gripping trace due to the concave portion is formed at the leading end portion of the transfer medium, the gripping trace does not pass the contact member. Therefore, the guidance of the transfer medium by the contact member is not affected by the gripping trace of the transfer medium and the guidance of the transfer medium by the contact member can be stably performed. As a result, a position of the transfer medium at the time of the guidance of the transfer medium by the contact member can be stabilized.

Further, a transfer medium transport belt which is the transfer medium transport surface having the suction hole is disposed between the contact members. Also, the contact member is disposed so as to be able to be moved by a driving member between an operation position where the transfer medium is transported and a retreat position where the transfer medium is not transported. Then, the movement of the contact member by the driving member is controlled by a control section, so that, while the transfer medium is moved by the driving force at the transfer roller, the transfer medium is guided by the contact member, and after the back end of the transfer medium passes through the transfer nip portion, the transfer medium is moved while being sucked by the driving force of the transfer medium transport belt. As a result of this, the transfer medium can be more smoothly moved and a position of the transfer medium can be further stabilized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a mode for carrying out the invention will be described by using the drawings.

Figure 1:
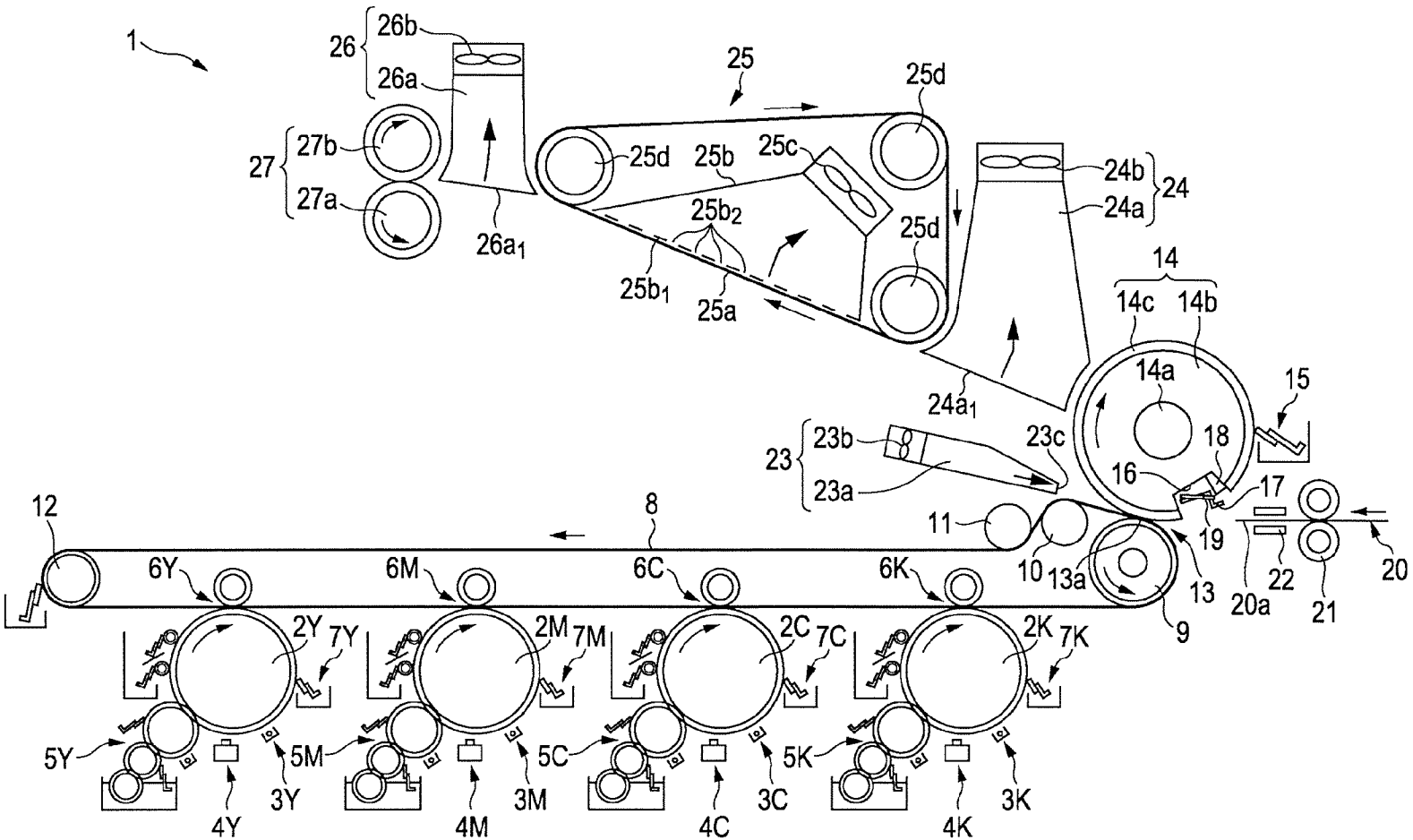
FIG. 1 is a diagram schematically and partially showing a portion of one example of an embodiment of an image forming apparatus according to the invention.

FIG. 1 is a diagram schematically and partially showing a portion of one example of an embodiment of an image forming apparatus according to the invention.

An image forming apparatus 1 of this example performs image formation by using a liquid developer containing toner and carrier liquid. As shown in FIG. 1, the image forming apparatus 1 is provided with photo conductors 2Y, 2M, 2C, and 2K which are image carriers for yellow (Y), magenta (M), cyan (C), and black (K), which are horizontally or approximately horizontally disposed in tandem. Here, in each of the photo conductors 2Y, 2M, 2C, and 2K, 2Y represents a photo conductor for yellow; 2M, a photo conductor for magenta; 2C, a photo conductor for cyan; and 2K, a photo conductor for black. Also with respect to other members, in the same way, a member for each color is represented by adding Y, M, C, or K representing each color to a symbol representing the member.

Also, electrification sections 3Y, 3M, 3C, and 3K are respectively disposed in the surroundings of the respective photo conductors 2Y, 2M, 2C, and 2K. Further, each of exposure sections 4Y, 4M, 4C, and 4K, each of development sections 5Y, 5M, 5C, and 5K, each of primary transfer sections 6Y, 6M, 6C, and 6K, and each of photo conductor cleaning sections 7Y, 7M, 7C, and 7K are disposed in order from each of the electrification sections 3Y, 3M, 3C, and 3K in the rotation direction of each of the photo conductors 2Y, 2M, 2C, and 2K. In addition, each of the photo conductors 2Y, 2M, 2C, and 2K is neutralized by each neutralization section (not shown) after primary transfer. An image forming unit of the image forming apparatus 1 of this example is constituted by each of the photo conductors 2Y, 2M, 2C, and 2K, each of the electrification sections 3Y, 3M, 3C, and 3K, each of the exposure sections 4Y, 4M, 4C, and 4K, each of the development sections 5Y, 5M, 5C, and 5K, each of the primary transfer sections 6Y, 6M, 6C, and 6K, each of the photo conductor cleaning sections 7Y, 7M, 7C, and 7K, and each of the neutralization sections.

Also, the image forming apparatus 1 is provided with an endless intermediate transfer belt 8 which is an image carrier in the invention. The intermediate transfer belt 8 is disposed vertically above the respective photo conductors 2Y, 2M, 2C, and 2K. Then, the intermediate transfer belt 8 is brought into pressure-contact with the respective photo conductors 2Y, 2M, 2C, and 2K by the respective primary transfer sections 6Y, 6M, 6C, and 6K.

Although it is not shown, the intermediate transfer belt 8 is formed by a relatively soft and elastic belt of a three-layered structure having a flexible base material such as resin, for example, an elastic layer such as rubber formed on the surface of the base material, and a surface layer formed on the surface of the elastic layer. Of course, the belt is not to be limited to this. The intermediate transfer belt 8 is wound around an intermediate transfer belt driving roller 9 to which the driving force of a motor (not shown) is transmitted, a first winding roller 10, a second winding roller 11, and an intermediate transfer belt tension roller 12. Then, the intermediate transfer belt 8 is made to rotate in the direction of an arrow in a state where tension is applied thereto. In addition, the disposition order of the members such as the photo conductors corresponding to the respective colors Y, M, C, and K is not to be limited to the example shown in FIG. 1, but can be arbitrarily set.

Figure 2A:
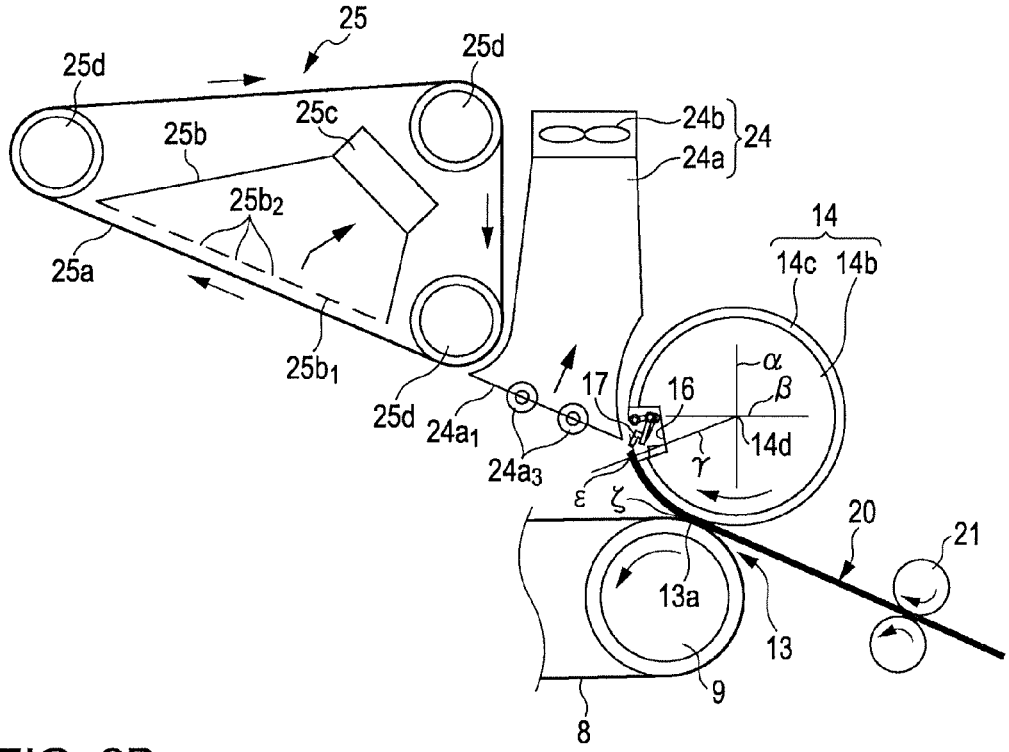
FIG. 2A is a diagram showing a transfer medium releasing position of a leading end portion of a transfer medium.
Figure 2B:
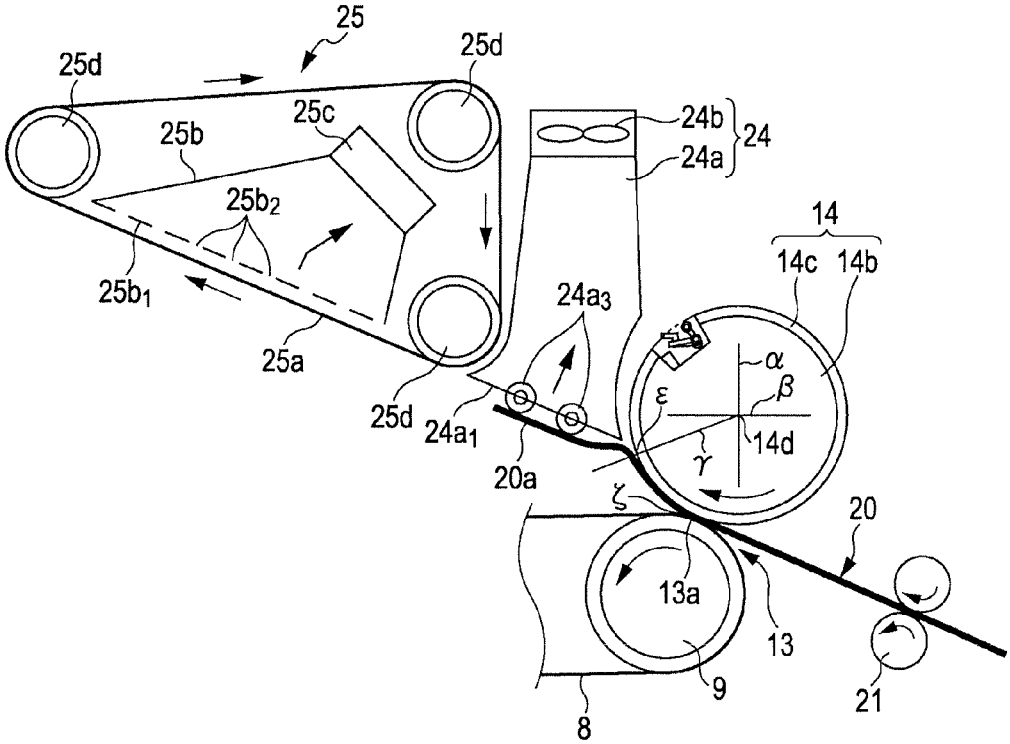
FIG. 2B is a diagram showing a state where the leading end portion of the transfer medium is guided to a transfer medium transport roller of a suction guide section.

A secondary transfer section 13 is provided on the intermediate transfer belt driving roller 9 side of the intermediate transfer belt 8. The secondary transfer section 13 is provided with a secondary transfer roller 14 and a secondary transfer roller cleaning section 15. The secondary transfer roller 14 rotates in the direction indicated by an arrow with a rotary shaft 14*a* as the center. The secondary transfer roller 14 is brought into pressure-contact with the intermediate transfer belt 8 which is wound around the intermediate transfer belt driving roller 9. At this time, as shown in FIGS. 2A and 2B, the secondary transfer roller 14 is brought into pressure-contact with the intermediate transfer belt 8 further on the left side in FIGS. 2A and 2B than a virtual vertical line α passing a rotation center 14*d* of the secondary transfer roller 14 and vertically underneath a virtual horizontal line β passing the rotation center 14*d* in FIGS. 2A and 2B. Also, the intermediate transfer belt driving roller 9 functions as a backup roller to the pressing of the secondary transfer roller 14. Further, the secondary transfer roller 14 rotates interlocked with the intermediate transfer belt 8 (that is, the intermediate transfer belt driving roller 9) by being brought into pressure-contact with the intermediate transfer belt 8.

Further, the secondary transfer roller 14 has a sheet-like elastic member 14*c* wrapped around the outer circumferential surface of a circular arc portion of a base material 14*b*. As a result of the elastic member 14*c*, a resistive layer is formed on the outer circumferential surface of a circular arc portion of the secondary transfer roller 14. Then, as shown in FIG. 1, a secondary transfer nip portion 13*a* is formed between the intermediate transfer belt 8 and the elastic member 14*c* of the secondary transfer roller 14. As shown in FIGS. 2A and 2B, the secondary transfer nip portion 13*a* is disposed further on the above-mentioned image forming unit side (the left side in FIGS. 2*a* and 2B) than the virtual vertical line α and also disposed further on the image forming unit side (the vertically lower side in FIGS. 2A and 2B) than the virtual horizontal line β.

As shown in FIGS. 1, 2A, 2B, and 3A to 3C, the secondary transfer roller 14 has a concave portion 16 in the circumferential surface thereof. In the concave portion 16, a gripper 17 as a transfer medium gripping member, a gripper support portion 18 which is a transfer medium gripping member receiving member on which the gripper 17 sits, and a protruding claw 19 as a transfer medium peeling member are disposed.

Figure 3A:
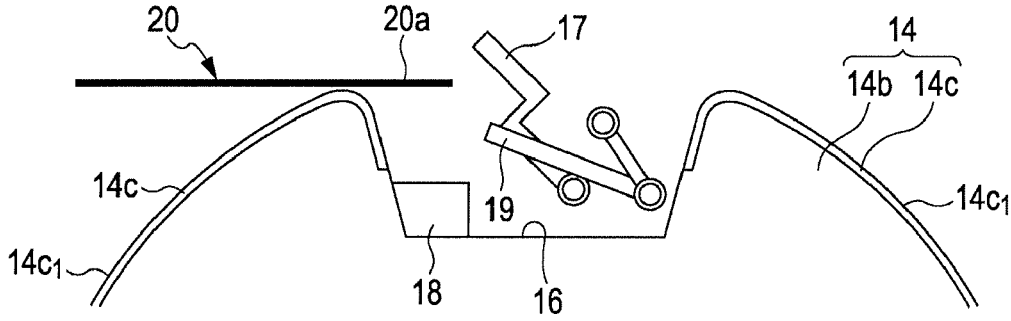
FIG. 3A is a diagram showing a state just before the gripping of the leading end portion of the transfer medium.
Figure 3B:
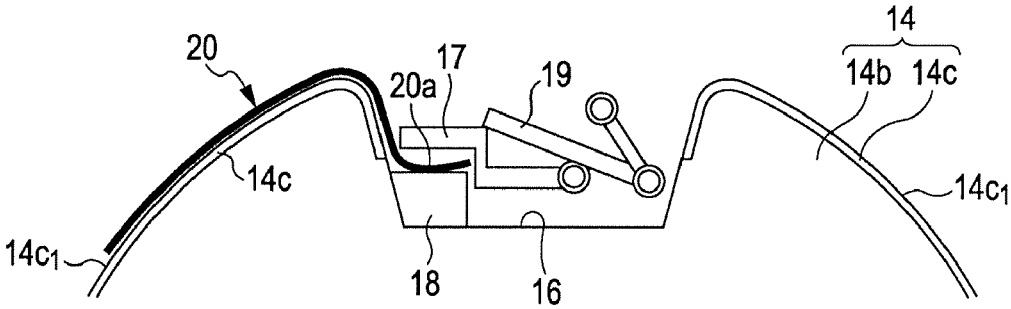
FIG. 3B is a diagram showing a state where the leading end portion of the transfer medium is gripped.
Figure 3C:
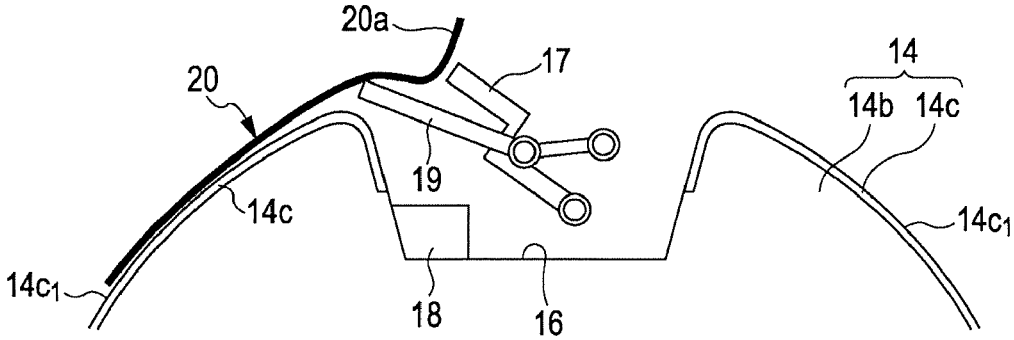
FIG. 3C is a diagram showing a protrusion state after release of the gripping of the leading end portion of the transfer medium.
Figure 4A:
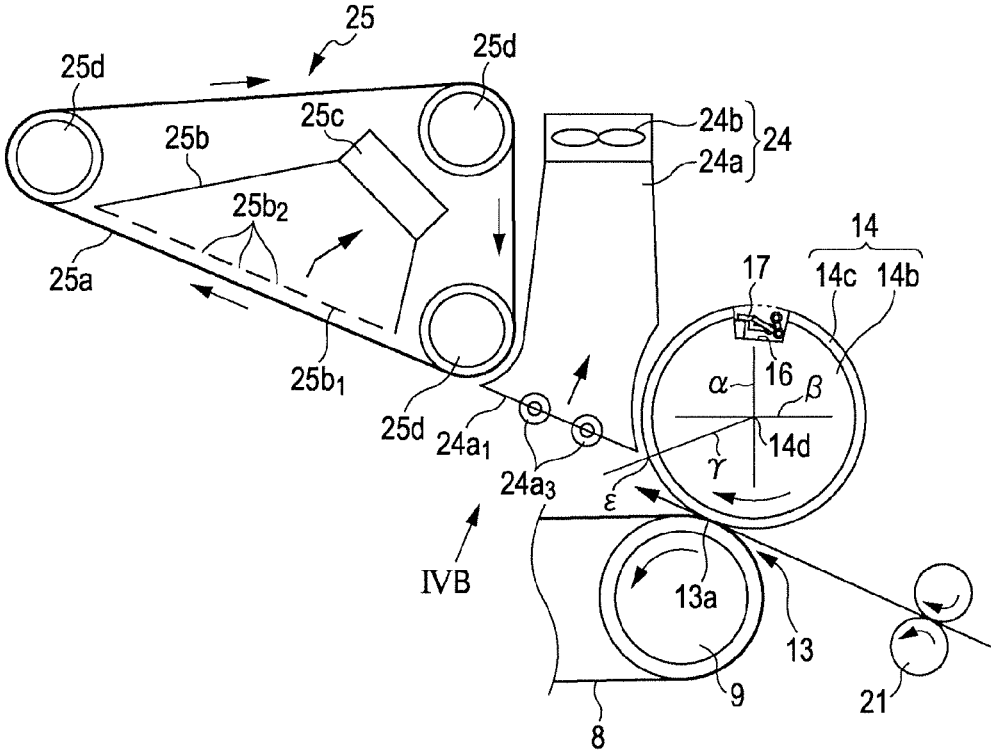
FIG. 4A is a diagram showing the transfer medium transport roller of the suction guide section.
Figure 4B:
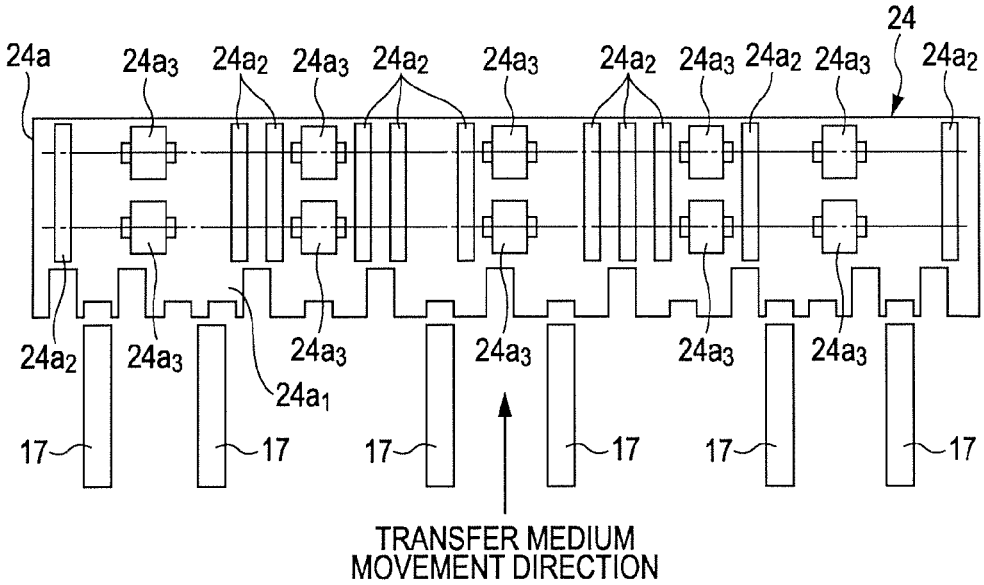
FIG. 4B is a diagram showing the suction guide section viewed from the direction of IVB in FIG. 4A.

As shown in FIG. 4B, a predetermined number (in the illustrated example, six pieces) of grippers 17 are disposed at predetermined intervals in the axial direction of the secondary transfer roller 14. The respective grippers 17 are turned (moved) in synchronization with each other between a transfer medium gripping release position shown in FIG. 3A and a transfer medium gripping position shown in FIG. 3B. In this case, at the transfer medium gripping release position, a portion of each gripper 17 protrudes further outside than the circumference of a virtual circle δ of the same diameter as an outer circumferential surface $14c_1$ of the elastic member 14*c* of the secondary transfer roller 14, that is, outside the concave portion 16, and at the transfer medium gripping position, the whole of the gripper is received further inside than the circumference of the virtual circle δ, that is, in the concave portion 16. Therefore, a portion of a transfer medium 20 gripped by each gripper 17 is located in the concave portion 16. Also, the protruding claw 19 is provided so as to move approximately linearly between a retreat position shown in FIG. 3A and a protrusion position shown in FIG. 3C. In this case, at the retreat position, the whole of the protruding claw 19 is housed in the concave portion 16, and at the protrusion position, a portion thereof protrudes from the concave portion 16. Although it is not shown, an operation of each of the gripper 17 and the protruding claw 19 is controlled by each cam fixed to an apparatus main body or the like of the image forming apparatus 1.

In this case, a transfer medium gripping start position where the gripper 17 starts to grip a leading end portion 20*a* of the transfer medium 20 is provided at a predetermined position before the concave portion 16 reaches a position of the secondary transfer nip portion 13*a*. Therefore, if the concave portion 16 reaches a position shown in FIG. 3A just before the transfer medium gripping start position, the leading end portion 20*a* of the transfer medium 20 which is fed and comes from a gate roller 21 through a transfer medium supply guide 22 reaches a position facing the concave portion 16, as shown in FIG. 3A. Then, the gripper 17 starts to be turned by a cam. When the concave portion 16 has reached the above-mentioned predetermined position, as shown in FIG. 3B, the gripper 17 is located at the transfer medium gripping start position, thereby gripping the leading end portion 20*a* of the transfer medium 20 between it and the gripper support portion 18. Then, the transfer medium 20 moves toward the secondary transfer nip portion 13*a* while wrapping around the outer circumferential surface of the elastic member 14*c* with the rotation of the secondary transfer roller 14.

The secondary transfer roller 14 is applied with a transfer bias which transfers a toner image transferred to the intermediate transfer belt 8 to the transfer medium 20 such as transfer paper. Then, the secondary transfer roller 14 rotates in the direction of an arrow at the time of the rotation of the intermediate transfer belt 8 in the direction of an arrow, as shown in FIG. 1, and by the application of the transfer bias, the toner image which is carried by the intermediate transfer belt 8 is transferred to the transfer medium 20 gripped by the gripper 17, at the secondary transfer nip portion 13*a*.

The secondary transfer roller cleaning section 15 removes the liquid developer attached to the elastic member 14*c* of the secondary transfer roller 14, by using a cleaning member thereof and also collects and stores the removed liquid developer in a liquid developer collection container.

As shown in FIG. 1, the image forming apparatus 1 is further provided with a first air flow generation device 23, a second air flow generation device 24, a transfer medium transport section 25, a third air flow generation device 26, and a fixing section 27 at a position vertically above the intermediate transfer belt 8.

The transfer medium 20 which has passed through the secondary transfer nip portion 13*a* is released from being gripped by the gripper 17. As shown in FIG. 2A, a transfer medium releasing position ϵ which is a position of the concave portion 16 where the gripper 17 releases the transfer medium 20 (more specifically, approximately an intersection point of a virtual straight line γ which connects the center of the gripper support portion 18 in the outer circumference direction of the secondary transfer roller 14 and the rotation center 14*d* of the secondary transfer roller 14, with the virtual circle δ of the same diameter as that of the outer circumference of the secondary transfer roller 14) is located further on the movement direction side (the image forming unit side; the left side in FIG. 2A) of the transfer medium 20 than a secondary transfer nip portion end position ζ of the secondary transfer nip portion 13*a* in a transfer medium movement direction (that is, is located further on the left side than the virtual vertical line α) and also located further on the image forming unit side (the lower side in FIG. 2A) than the virtual horizontal line β. Therefore, both the transfer medium releasing position ϵ and the secondary transfer nip portion end position ζ of the secondary transfer nip portion 13*a* are located in the third quadrant which is formed by the virtual vertical line α and the virtual horizontal line β. The secondary transfer nip portion end position ζ is a position where the intermediate transfer belt 8 is separated from the transfer medium 20.

If the portion of the transfer medium 20 gripped by the gripper 17 reaches a position just before the transfer medium releasing position ϵ, the gripper 17 starts to be turned by the cam. When the portion of the transfer medium 20 gripped by the gripper 17 has reached the transfer medium releasing position ϵ, as shown in FIG. 2A, the gripper 17 is located at the transfer medium gripping release position, thereby releasing gripping of the leading end portion 20*a* of the transfer medium 20. As a result of this, the transfer medium 20 is released. At this time, as shown in FIG. 3C, at the leading end portion 20*a* of the transfer medium 20, a gripping trace due to the concave portion 16, which is curved in an approximately V-shape to the transfer image surface side, is formed.

Approximately at the same time as the releasing of the transfer medium 20 by the gripper 17, the protruding claw 19 starts to be moved by a cam. Then, as shown in FIG. 3C, the protruding claw 19 protrudes from the concave portion 16 of the secondary transfer roller 14, thereby reaching a protrusion position while pushing out the back surface (the surface opposite to a transfer image surface) of the transfer medium 20. As a result of this, the transfer medium 20 is peeled from the secondary transfer roller 14 and then moves toward the second air flow generation device 24, as shown in FIG. 2B. If the gripper 17 reaches a predetermined position after the releasing of the transfer medium 20, the gripper is housed in the concave portion 16 by the cam, and if the gripper reaches a predetermined position before the transfer medium gripping start position, the gripper is at the transfer medium gripping release position. Also, if the protruding claw 19 reaches a predetermined position after the pushing-out of the transfer medium 20, the protruding claw is housed in the concave portion 16 by the cam. That is, the gripper 17 and the protruding claw 19 are made so as not to interfere with (come into contact with) the second air flow generation device 24.

As shown in FIG. 1, the first air flow generation device 23 has a duct-shaped air feed member 23*a* and an air flow generation section 23*b* such as a fan (for example, a sirocco fan). An air flow is generated in the air feed member 23*a* by the driving of the air flow generation section 23*b*, and air is discharged from an air feed opening 23*c* of the air feed member 23*a* toward the secondary transfer nip portion 13*a*.

As shown in FIGS. 1 and 4A, the second air flow generation device 24 has a duct-shaped suction member 24*a* which is a suction guide section in the invention, and an air flow generation section 24*b* such as a fan (for example, a sirocco fan). The suction member 24*a* has a guide surface $\mathbf{24}a_1$ which guides the transfer medium 20. The guide surface $\mathbf{24}a_1$ is formed into an inclined surface inclined from the lower right toward the upper left in FIGS. 1 and 4A.

As shown in FIG. 4B, at the guide surface $\mathbf{24}a_1$, a predetermined number of (in the illustrated example, eleven) suction holes $\mathbf{24}a_2$ which extend in the movement direction of the transfer medium 20 are provided. These suction holes $\mathbf{24}a_2$ are arranged in the direction perpendicular or approximately perpendicular to the movement direction of the transfer medium 20. In this case, all the suction holes $\mathbf{24}a_2$ are disposed between the positions on the guide surface $\mathbf{24}a_1$, which correspond to all the grippers 17, in the direction perpendicular or approximately perpendicular to the movement direction of the transfer medium 20. Therefore, all the suction holes $\mathbf{24}a_2$ do not overlap with the respective grippers 17 in the movement direction of the transfer medium 20.

Further, as shown in FIGS. 2A, 2B, 4A, and 4B, at the guide surface $\mathbf{24}a_1$, a plurality of transfer medium transport rollers $\mathbf{24}a_3$ are provided which are contact members and roller members which come into contact with the transfer medium 20. The material of each transfer medium transport roller $\mathbf{24}a_3$ is formed of resin or metal. In particular, if the transfer medium transport roller $\mathbf{24}a_3$ is formed of resin such as POM, for example, it is preferable since it is light in weight and easily rotates and also the surface thereof can become smooth.

As shown in FIG. 4B, the transfer medium transport rollers $\mathbf{24}a_3$ are arranged in two rows in the direction perpendicular or approximately perpendicular to the movement direction of the transfer medium 20 and also disposed divided in a plurality (in the illustrated example, five) per one row. Also, the respective transfer medium transport rollers $\mathbf{24}a_3$ of the second row are aligned corresponding to the respective transfer medium transport rollers $\mathbf{24}a_3$ of the first row in the direction perpendicular or approximately perpendicular to the movement direction of the transfer medium 20. In this case, all the transfer medium transport rollers $\mathbf{24}a_3$ are disposed between the suction holes $\mathbf{24}a_2$ in the direction perpendicular or approximately perpendicular to the movement direction of the transfer medium 20. Further, all the transfer medium transport rollers $\mathbf{24}a_3$ are disposed between the positions on the guide surface $\mathbf{24}a_1$, which correspond to the respective grippers 17, in the direction perpendicular or approximately perpendicular to the movement direction of the transfer medium 20. Therefore, all the transfer medium transport rollers $\mathbf{24}a_3$ do not overlap with the respective grippers 17 in the movement direction of the transfer medium 20. In addition, any of the respective transfer medium transport rollers $\mathbf{24}a_3$ may also be disposed so as to overlap with any of the respective grippers 17 in the movement direction of the transfer medium 20.

Further, all the transfer medium transport rollers $\mathbf{24}a_3$ are disposed between two grippers 17 which are disposed at both ends in the direction (the axial direction of the secondary transfer roller 14) perpendicular or approximately perpendicular to the movement direction of the transfer medium 20. That is, the distance (width) between the gripping traces which are formed at both ends in the direction (the axial direction of the secondary transfer roller 14) perpendicular or approximately perpendicular to the movement direction of the transfer medium 20, among the gripping traces of the leading end portion 20*a* of the transfer medium 20 by the gripping of the grippers 17, is longer than the distance (width) between two transfer medium transport rollers $\mathbf{24}a_3$ of each row, which are disposed at both ends in the direction (the axial direction of the secondary transfer roller 14) perpendicular or approximately perpendicular to the movement direction of the transfer medium 20. Then, all the transfer medium transport rollers $\mathbf{24}a_3$ are made so as to rotate about shafts extending in the direction perpendicular or approximately perpendicular to the movement direction of the transfer medium 20. Also, a portion of each of all the transfer medium transport rollers $\mathbf{24}a_3$ protrudes from the guide surface $\mathbf{24}a_1$ to the movement pathway side of the transfer medium 20.

By the driving of the air flow generation section 24*b*, the suction member 24*a* sucks air in the direction indicated by an arrow opposite to the force of gravity through the respective suction holes, thereby generating an air flow. Then, as shown in FIG. 2B, the transfer medium 20 peeled from the secondary transfer roller 14 is curved approximately at the transfer medium releasing position ϵ and guided along the guide surface $\mathbf{24}a_1$ of the suction member 24*a* while the back surface thereof is sucked obliquely upward in a vertical direction (upward in a vertical direction in the direction approximately perpendicular to the guide surface $\mathbf{24}a_1$) by the air flow which is generated by the second air flow generation device 24. In this case, the back surface of the transfer medium 20 comes into contact with the respective transfer medium transport rollers $\mathbf{24}a_3$, and also the transfer medium transport rollers $\mathbf{24}a_3$ rotate with the movement of the transfer medium 20, whereby the transfer medium 20 moves smoothly. Also, as described above, although the gripping trace due to the concave portion 16, which is curved to the transfer image surface side, is formed at the leading end portion 20*a* of the transfer medium 20, the gripping trace of the leading end portion 20*a* does not overlap with each suction hole 24$a_2$. Therefore, the transfer medium 20 is sucked and guided in a stable position.

Figure 5:
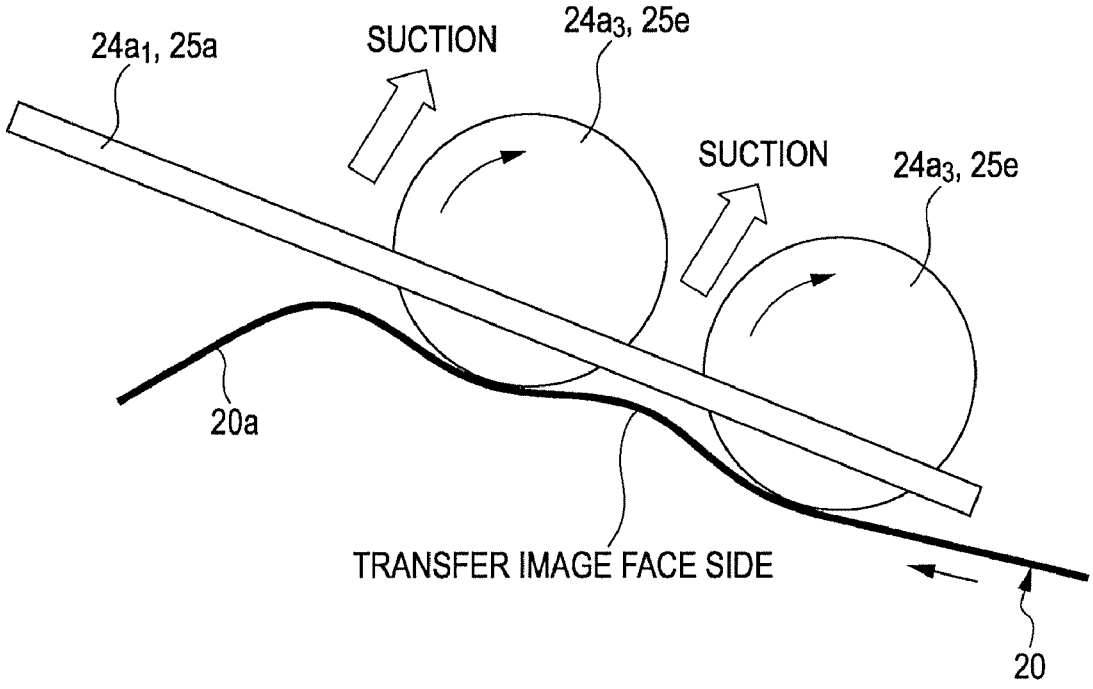
FIG. 5 is a diagram explaining the guidance of a back surface of the transfer medium by the transfer medium transport roller.

Furthermore, as described above, in a case where any of the respective transfer medium transport rollers 24$a_3$ is disposed so as to overlap with any of the respective grippers 17 in the movement direction of the transfer medium 20, when the leading end portion 20*a* of the transfer medium 20 comes into contact with the transfer medium transport roller 24$a_3$, as shown in FIG. 5, the leading end portion is led in a direction away from the guide surface 24$a_1$ by each transfer medium transport roller 24$a_3$. Therefore, the leading end portion 20*a* of the transfer medium 20 is prevented from being wrapped around the transfer medium transport roller 24$a_3$, thereby penetrating between the transfer medium transport rollers 24$a_3$ adjacent to each other in the transfer medium movement direction, so that the transfer medium 20 moves more smoothly along the guide surface 24$a_1$. In addition, the transfer medium 20 is moved toward the transfer medium transport section 25 by rotational forces of the intermediate transfer belt 8 and the secondary transfer roller 14.

As shown in FIGS. 1, 2A, 2B, 6A, and 6B, the transfer medium transport section 25 has a transfer medium transport belt 25*a* which is a transfer medium transport surface, a duct-shaped suction member 25*b*, and an air flow generation section 25*c* such as a fan (for example, a sirocco fan). As shown in FIG. 7, the transfer medium transport belt 25*a* includes a predetermined number of (in the illustrated example, four) endless belts 25$a_1$ which are disposed at predetermined intervals in the movement direction of the transfer medium 20 and also wound around three winding rollers 25*d*. In this case, one of the three winding rollers 25*d* is a transfer medium transport belt driving roller which rotates the transfer medium transport belt 25*a*. Each of the endless belts 25$a_1$ has a number of suction holes 25$a_2$. In this case, although it is not shown in FIG. 7, similarly to the case of the above-mentioned suction holes 24$a_2$, all the suction holes 25$a_2$ are disposed between the positions on the transfer medium transport belt 25*a*, which correspond to all the grippers 17, in the direction perpendicular or approximately perpendicular to the movement direction of the transfer medium 20. Therefore, all the suction holes 25$a_2$ do not overlap with all the grippers 17 in the movement direction of the transfer medium 20.

Then, the transfer medium transport belt 25*a* rotates in the direction (the clockwise direction) indicated by an arrow in FIGS. 1, 2A, 2B, 6A, and 6B. A transfer medium transport direction of a transfer medium transport belt portion of the transfer medium transport belt 25*a* is inclined in a direction oblique from the lower right to the upper left in FIGS. 1, 2A, and 2B. In this case, an inclination angle of the transfer medium transport direction of the transfer medium transport belt 25*a* with respect to the horizontal direction is the same or approximately the same as an inclination angle of the guide direction of the guide surface 24$a_1$ of the second air flow generation device 24 with respect to the horizontal direction. In addition, although in FIG. 1, the transfer medium transport belt 25*a* is shown so as to be wound around three winding rollers 25*d*, a configuration may also be made such that the transfer medium transport belt is wound around two winding rollers 25*d* or four or more winding rollers 25*d*.

The suction member 25*b* has a number of suction holes 25$b_2$ at a facing guide surface 25$b_1$ which is located in the vicinity of the transport pathway of the transfer medium 20 and also faces the transfer medium transport belt 25*a*. In this case, although it is not shown in FIG. 7, similarly to the case of the above-mentioned suction holes 24$a_2$, all the suction holes 25$b_2$ are disposed between the positions on the facing guide surface 25$b_1$, which correspond to all the grippers 17, in the direction perpendicular or approximately perpendicular to the movement direction of the transfer medium 20. Therefore, all the suction holes 25$b_2$ do also not overlap with all the grippers 17 in the movement direction of the transfer medium 20.

Figure 6A:
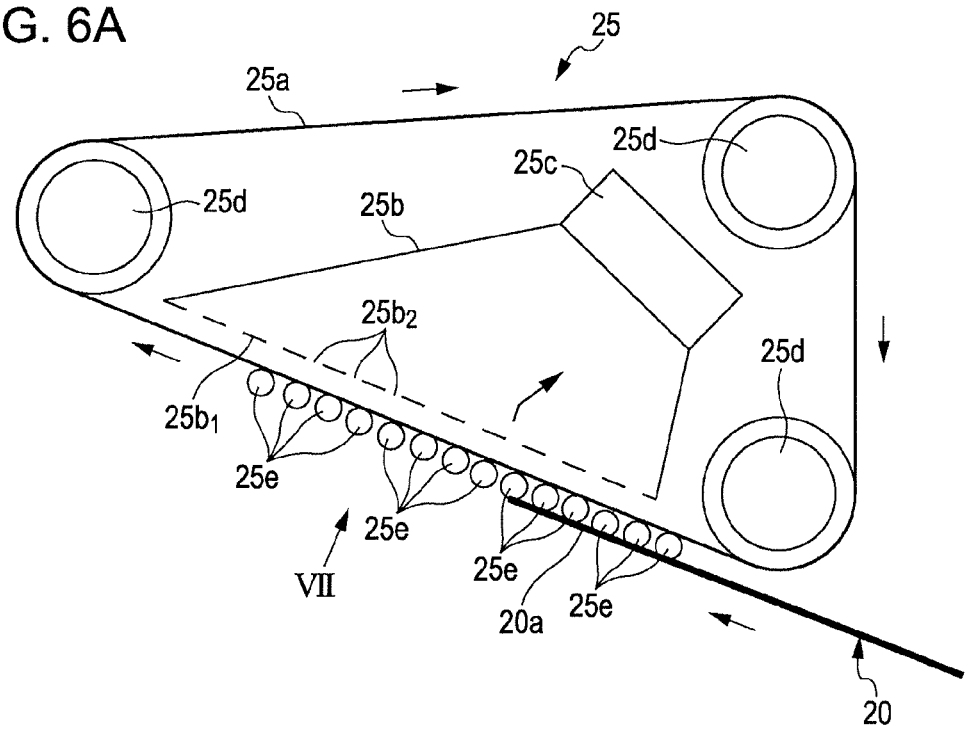
FIG. 6A is a diagram explaining the guidance of the transfer medium by the transfer medium transport roller of a transfer medium transport section.
Figure 6B:
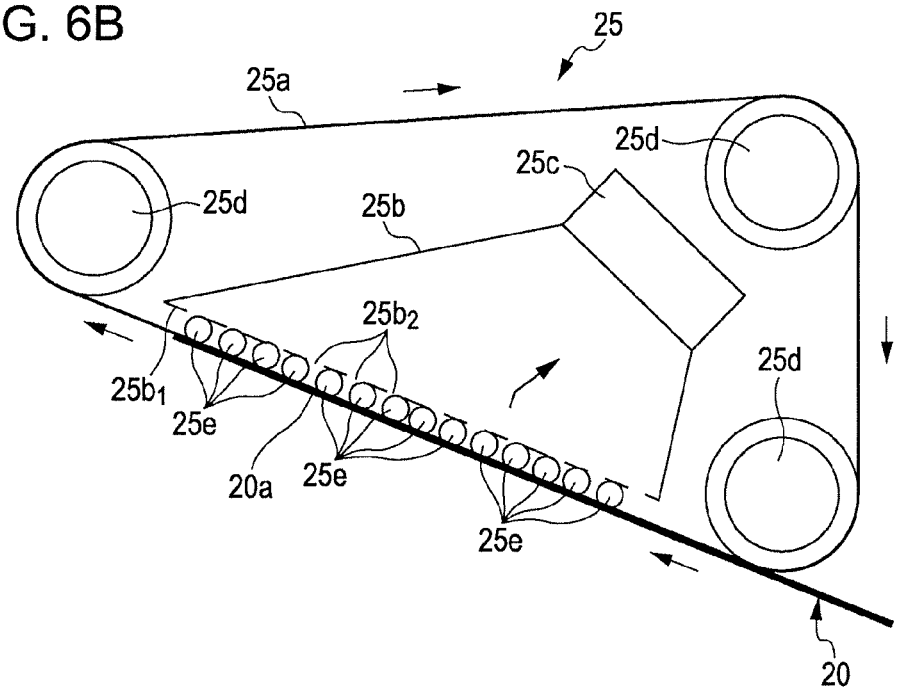
FIG. 6B is a diagram explaining the transport of the transfer medium by a transfer medium transport belt of the transfer medium transport section.
Figure 7:
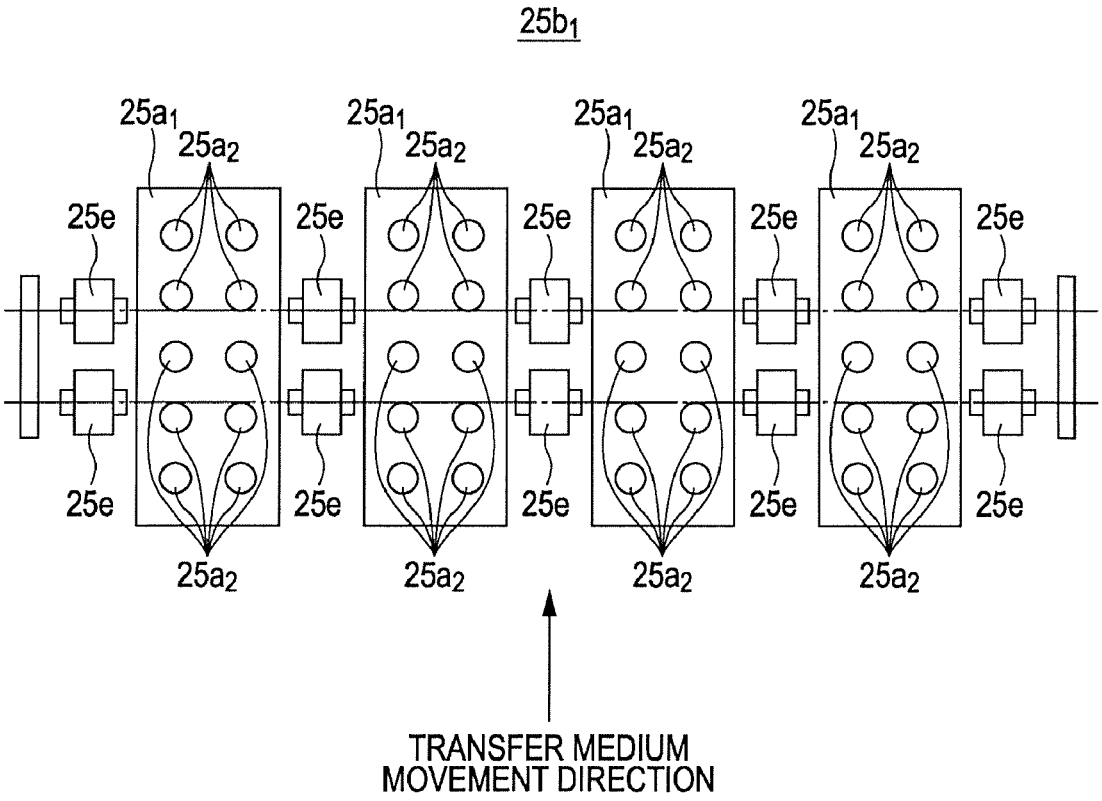
FIG. 7 is a diagram showing a portion of the transfer medium transport section viewed from the direction of VII in FIG. 6A.

Also, as shown in FIGS. 6A and 6B, the suction member 25*b* has a number of transfer medium transport rollers 25*e* which are contact members and roller members which come into contact with the transfer medium 20. These transfer medium transport rollers 25*e* rotate about shafts extending in the direction perpendicular or approximately perpendicular to the movement direction of the transfer medium 20. As shown in FIG. 7, the transfer medium transport rollers 25*e* are disposed divided into a plurality (in the illustrated example, five) per one row in the direction perpendicular or approximately perpendicular to the movement direction of the transfer medium 20. In this case, the respective transfer medium transport rollers 25*e* are disposed between the respective endless belts 25$a_1$ and outside the endless belts 25$a_1$ which are located at both ends. That is, the respective endless belts 25$a_1$ are disposed between the respective transfer medium transport rollers 25*e*. The rows of the transfer medium transport rollers 25*e* are disposed in a predetermined number of rows (in the illustrated example, 14 rows) in the movement direction of the transfer medium 20. Further, all the transfer medium transport rollers 25*e* are disposed between the positions on the transfer medium transport section 25, which correspond to two grippers 17 which are disposed at both ends in the direction (the axial direction of the secondary transfer roller 14) perpendicular or approximately perpendicular to the movement direction of the transfer medium 20. That is, the distance (width) between the gripping traces which are formed at both ends in the direction (the axial direction of the secondary transfer roller 14) perpendicular or approximately perpendicular to the movement direction of the transfer medium 20, among the gripping traces of the leading end portion 20*a* of the transfer medium 20 by the gripping of the grippers 17, is longer than the distance (width) between two transfer medium transport rollers 25*e* of each row, which are disposed at both ends in the direction (the axial direction of the secondary transfer roller 14) perpendicular or approximately perpendicular to the movement direction of the transfer medium 20. Therefore, all the transfer medium transport rollers 25*e* do not overlap with all the grippers 17 in the movement direction of the transfer medium 20.

Further, each transfer medium transport roller 25*e* is made so as to be able to be moved between an operation position shown in FIG. 6A and a retreat position shown in FIG. 6B. Then, in the operation position shown in FIG. 6A, each transfer medium transport roller 25*e* protrudes from the transfer medium transport belt 25*a* to the transfer medium movement pathway side. As a result of this, each transfer medium transport roller 25*e* transports the transfer medium 20 while guiding the back surface of the transfer medium 20. Also, in the retreat position shown in FIG. 6B, each transfer medium transport roller 25*e* is located further on the suction member 25*b* side than the transfer medium transport belt 25*a*, so that it does not protrude from the transfer medium transport belt 25*a* to the transfer medium movement pathway side.

In addition, the endless belts 25$a_1$ are not to limited to four belts, but arbitrary number of belts may be provided, and each transfer medium transport roller 25*e* may also be similarly provided by the number of portions corresponding to the number of endless belts 25$a_1$ provided per one row. Further, the rows of the transfer medium transport rollers 25*e* in the transfer medium movement direction may also be provided by arbitrary number of rows.

By the driving of the air flow generation section 25*c*, the suction member 25*b* sucks air in the direction indicated by an arrow opposite to the force of gravity through the respective suction holes, thereby generating an air flow. Then, as shown in FIG. 6A, the transfer medium 20 which has been sucked and guided by the second air flow generation device 24 is sucked at the back surface thereof obliquely upward in a vertical direction (upward in a vertical direction in the direction approximately perpendicular to the facing guide surface 25$b_1$) through the suction holes 25$a_2$ of the transfer medium transport belt 25*a* and the suction holes 25$b_2$ of the suction member 25*b* by the air flow which is generated by the air flow generation device 25*c* of the transfer medium transport section 25.

At a point of time when the leading end of the transfer medium 20 reaches the transfer medium transport section 25, each transfer medium transport roller 25*e* is already present at the operation position shown in FIG. 6A. Therefore, the back surface of the transfer medium 20 comes into contact with each transfer medium transport roller 25*e*, and also these transfer medium transport rollers 25*e* rotate with the movement of the transfer medium 20, so that the transfer medium 20 moves smoothly while the back surface thereof is sucked.

As described above, in a case where any of the respective transfer medium transport rollers 25*e* is disposed so as to overlap with any of the respective grippers 17 in the movement direction of the transfer medium 20, when the leading end portion 20*a* of the transfer medium 20 comes into contact with the transfer medium transport rollers 25*e*, as shown in FIG. 5, the leading end portion is led in a direction away from the guide surface 25$b_1$ by each transfer medium transport roller 25*e*. Therefore, the leading end portion 20*a* of the transfer medium 20 is prevented from being wrapped around the transfer medium transport rollers 25*e*, thereby penetrating between the transfer medium transport rollers 25*e* adjacent to each other in the transfer medium movement direction, so that the transfer medium 20 moves more smoothly while being guided by each transfer medium transport roller 25*e*. At this time, the transfer medium 20 is moved toward the third air flow generation device 26 by rotational forces of the intermediate transfer belt 8 and the secondary transfer roller 14 without coming into contact with the transfer medium transport belt 25*a*.

Then, at a point of time when the leading end of the transfer medium 20 reaches the transfer medium transport roller 25*e* of the row which is located furthest on the third air flow generation device 26 (that is, the fixing section 27) side, as shown in FIG. 6B, each transfer medium transport roller 25*e* is located at the retreat position. Therefore, the transfer medium 20 is sucked to the transfer medium transport belt 25*a*. Also, at this point, the back end of the transfer medium 20 has passed through the secondary transfer nip portion 13*a*. Therefore, the transfer medium 20 is transported toward the third air flow generation device 26 while being sucked by the transfer medium transport belt 25*a*. In this case, the gripping trace of the leading end portion 20*a* of the transfer medium 20 does not overlap with each of the suction holes 25$a_2$ and 25$b_2$. Therefore, the transfer medium 20 is sucked and transported in a stable position.

A point of time when each transfer medium transport roller 25*e* is moved from the operation position to the retreat position is set in accordance with the size of the transfer medium 20. That is, a point of time when each transfer medium transport roller 25*e* is moved from the operation position to the retreat position is a point of time when the back end of the transfer medium 20 has passed through the secondary transfer nip portion 13*a*. In this case, it is preferable that each transfer medium transport roller 25*e* be moved from the operation position to the retreat position at a point of time when the leading end of the largest size (a size in the transfer medium movement direction) of the transfer medium 20 which is used in the image forming apparatus 1 of this example reaches the transfer medium transport roller 25*e* of the row which is located furthest on the third air flow generation device 26 side, as shown in FIG. 6B. In addition, a configuration is made such that even in the case of the smallest size (a size in the transfer medium movement direction) of the transfer medium 20 among the transfer mediums 20 which are used in the image forming apparatus 1 of this example, the leading end of the transfer medium 20 reaches a transfer medium transport section starting position η of the transfer medium transport section 25 before the back end of the transfer medium 20 passes through the secondary transfer nip portion 13*a*. The transfer medium transport section starting position η is a suction start position of the transfer medium 20 by the transfer medium transport section 25.

Figure 8:
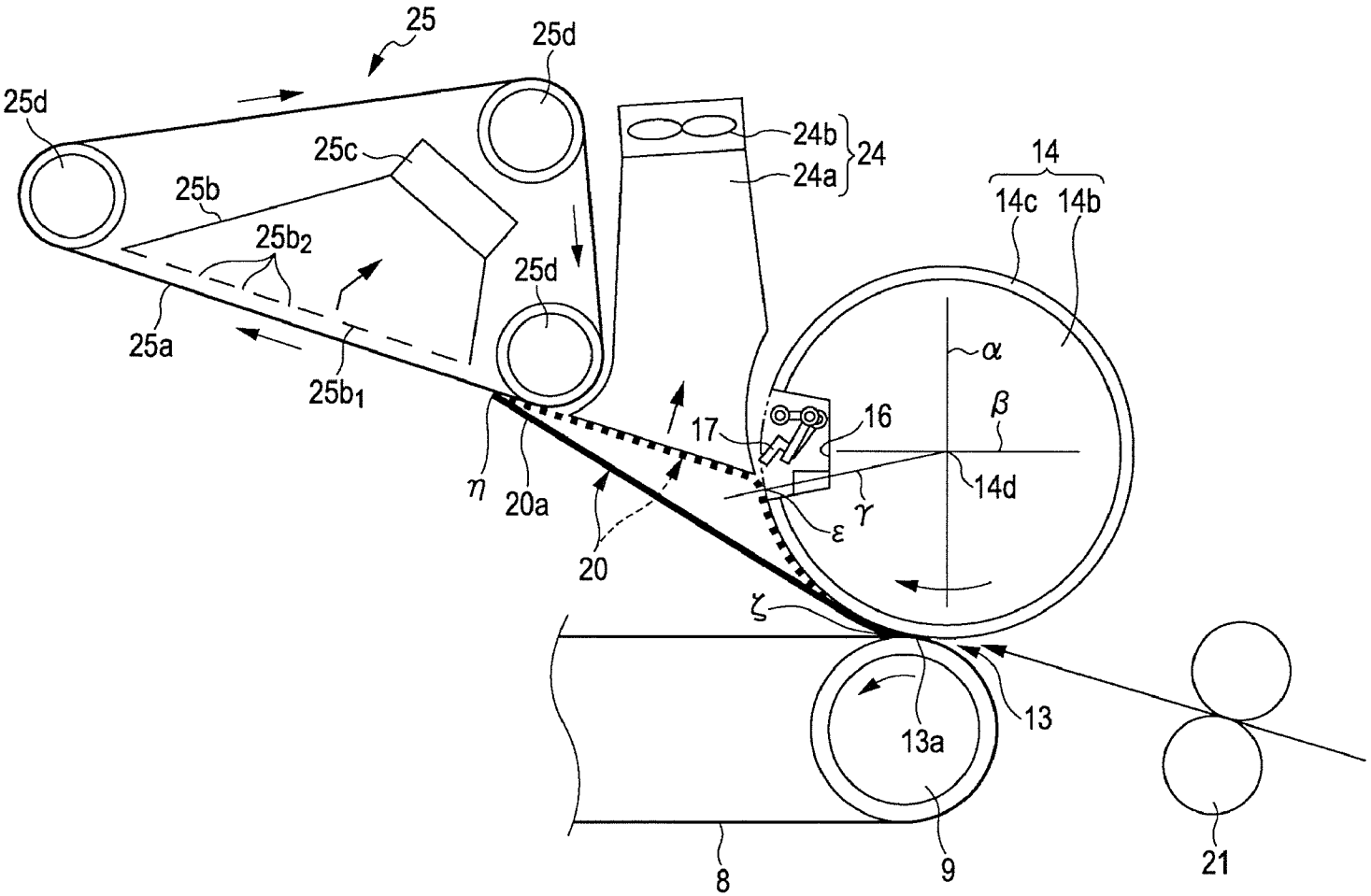
FIG. 8 is a diagram explaining changes in a movement pathway of the transfer medium.

Here, as shown in FIG. 8, a position where the transfer medium 20, which has been sucked and guided by the second air flow generation device 24, starts to be sucked to the transfer medium transport belt 25*a* of the transfer medium transport section 25 is the transfer medium transport section starting position η. The transfer medium transport section starting position η is a position where the transfer medium transport section 25 starts to suck the transfer medium 20. Then, the transfer medium releasing position ϵ of the secondary transfer roller 14, the secondary transfer nip portion end position ζ of the secondary transfer nip portion 13*a*, and the transfer medium transport section starting position η are disposed so as to form a virtual approximate triangle when viewed from the direction perpendicular or approximately perpendicular to the transfer medium movement direction (the direction parallel or approximately parallel to the axial direction of the secondary transfer roller 14).

Figure 9:
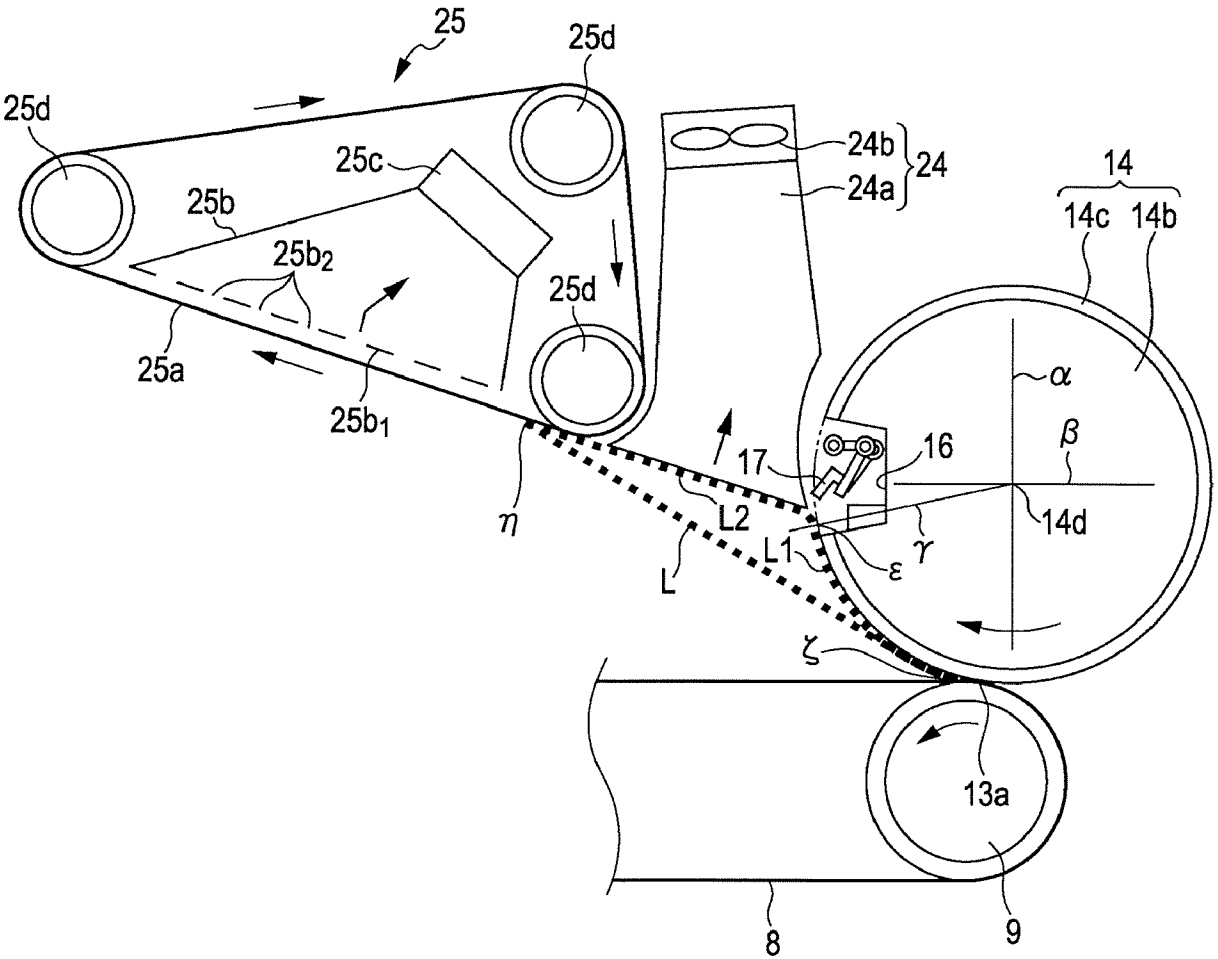
FIG. 9 is a diagram showing a position where the transfer medium is separated from an image carrier, a transfer medium releasing position, and a position where the transfer medium transport section starts to suck the transfer medium.

In this case, the length of each side of the virtual approximate triangle is defined as follows. Now, as shown in FIG. 9, the distance (that is, approximately corresponding to the length of the side of the virtual approximate triangle between the secondary transfer nip portion end position ζ and the transfer medium releasing position ϵ) between the secondary transfer nip portion end position ζ where the intermediate transfer belt 8 is separated from the transfer medium 20 and the transfer medium releasing position ϵ where the gripper 17 releases the transfer medium 20 is set to be L1. Also, the distance (that is, approximately corresponding to the length of the side of the virtual approximate triangle between the transfer medium releasing position ϵ and the transfer medium transport section starting position η) between the transfer medium releasing position ϵ where the gripper 17 releases the transfer medium 20 and the transfer medium transport section starting position η where the transfer medium transport section 25 sucks the transfer medium 20 is set to be L2. Also, the distance (that is, approximately corresponding to the length of the side of the virtual approximate triangle between the secondary transfer nip portion end position ζ and the transfer medium transport section starting position η) between the secondary transfer nip portion end position ζ where the intermediate transfer belt 8 is separated from the transfer medium 20 and the position η where the transfer medium transport section 25 starts to suck the transfer medium 20 is set to be L. Then, the distance L has the relationship of L<L1+L2 with respect to other two distances L1 and L2.

Also, in terms of smooth transportation of the transfer medium 20, it is preferable that the virtual approximate triangle be formed into an approximate triangle in which the angle that the side between the secondary transfer nip portion end position ζ and the transfer medium releasing position ϵ makes with the side between the transfer medium releasing position ϵ and the transfer medium transport section starting position η is an obtuse angle. The transfer medium 20 moves from the lower right to the upper left in FIG. 8 from the secondary transfer nip portion end position ζ toward the transfer medium transport section starting position η approximately through the transfer medium releasing position ϵ along the movement pathways of two sides of the virtual approximate triangle, which are represented by a dotted line.

Then, like the image forming apparatus 1 of this example, in a case where the transfer medium transport rollers 25*e* are not provided at the transfer medium transport section 25, the transfer medium 20 is transported by the transfer medium transport belt 25*a*. In this case, if the transportation of the transfer medium 20 is started, since a difference in velocity is present between a movement velocity of the transfer medium 20 which is transported by the transfer medium transport belt 25*a* and a movement velocity of the transfer medium 20 which is transported by the secondary transfer roller 14, as described above, the portion of the transfer medium 20, which has passed through the secondary transfer nip portion 13*a*, is bent downward in a vertical direction by its own weight with each of the transfer medium transport section starting position η and the secondary transfer nip portion end position ζ of the secondary transfer nip portion 13*a* as fulcrums. Then, the transfer medium 20 attempts to move approximately along the movement pathway of an approximately straight line shape shown by a solid line in FIG. 8, which connects the transfer medium transport section starting position η and the secondary transfer nip portion end position ζ of the secondary transfer nip portion 13*a*. Therefore, there are the above-mentioned problems where the movement pathway of the transfer medium 20 is changed to be short and the position of the transfer medium 20 varies.

Therefore, in the image forming apparatus 1 of this example, the transfer medium portion which has reached the transfer medium transport section 25 is moved smoothly by the transfer medium transport rollers 25*e* of the transfer medium transport section 25, so that the above-mentioned difference in velocity is suppressed. As a result of this, the portion of the transfer medium 20 which has passed through the secondary transfer nip portion 13*a* is suppressed from being largely bent downward in a vertical direction, so that positional variation of the transfer medium 20 is prevented.

Figure 10:
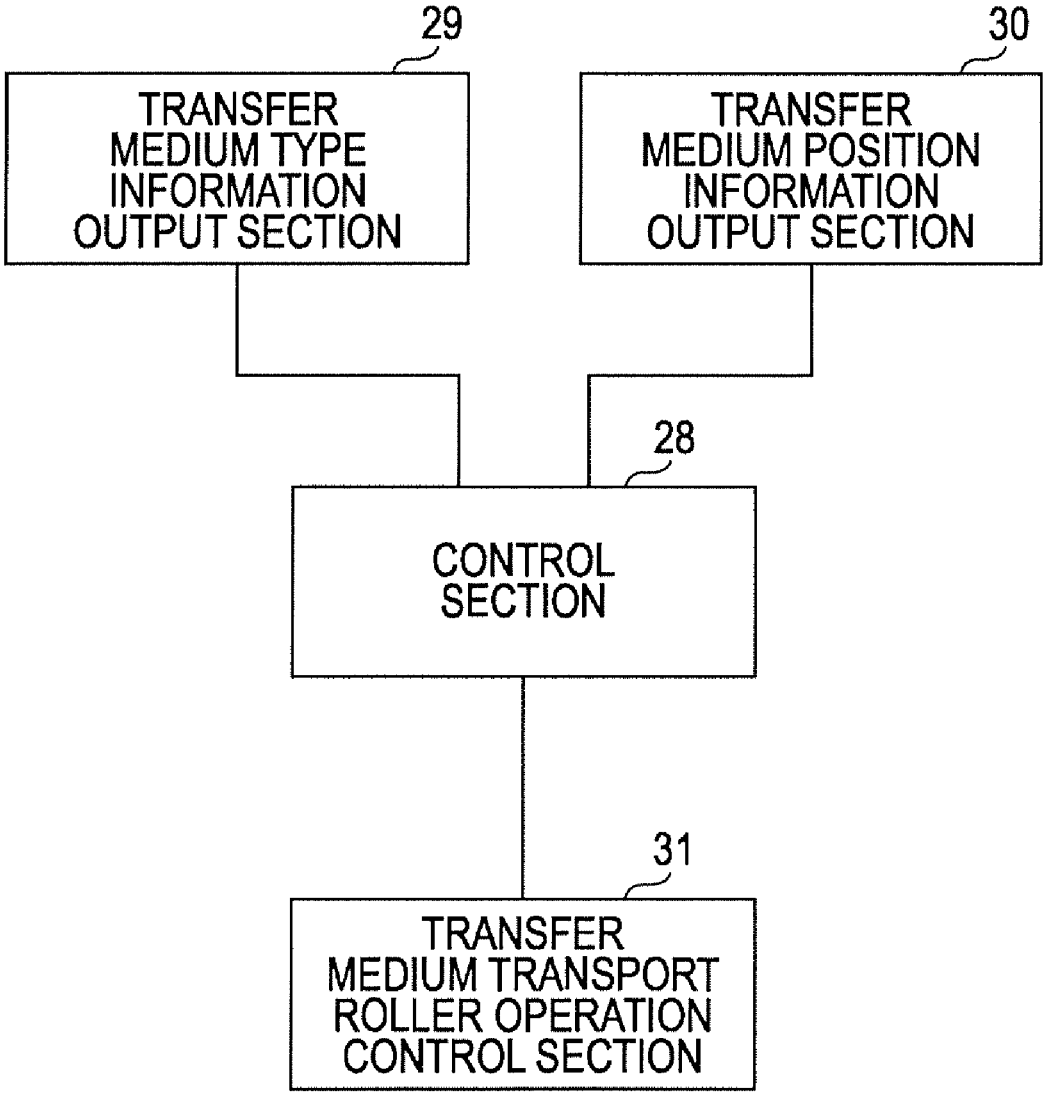
FIG. 10 is a block diagram of the control of the transfer medium transport roller.
Figure 11:
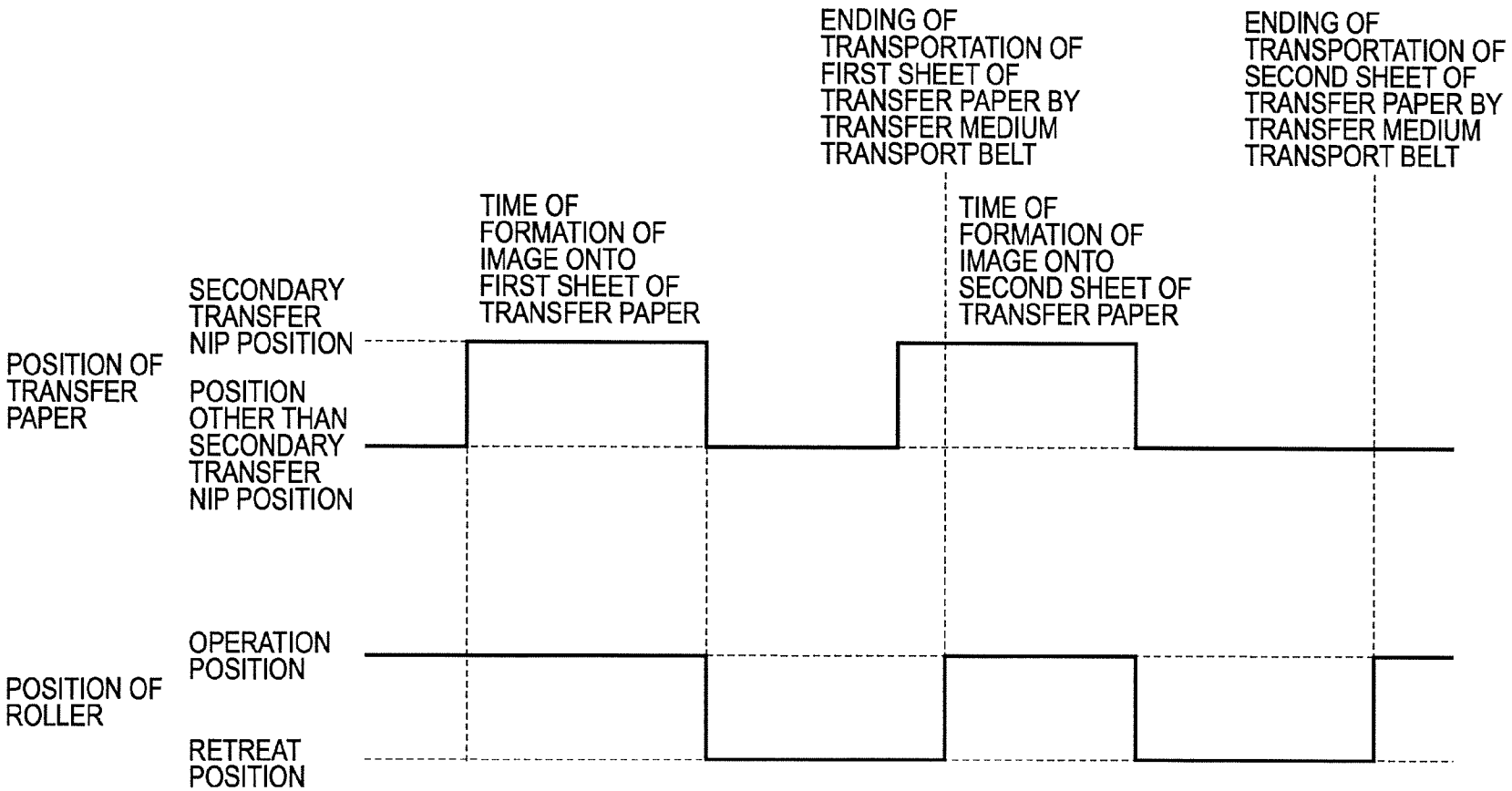
FIG. 11 is a diagram showing a timing chart of the control of the transfer medium transport roller.

FIG. 10 is a block diagram of the operation control of the roller of the transfer medium transport section, and FIG. 11 is a diagram showing a timing chart of the operation control of the roller.

As shown in FIG. 10, a transfer medium type information output section 29, a transfer medium position information output section 30, and a transfer medium transport roller operation control section 31 are connected to a control section 28 of the image forming apparatus 1.

The transfer medium type information output section 29 outputs the information on the size (for example, lengthwise A4 size, breadthways A4 size, B5 size, B4 size, or the like) of the transfer medium 20 which is used, to the control section 28. The transfer medium type information output section 29 is provided as a transfer medium type set section such as an operation key at an image formation operation panel of the image forming apparatus 1.

Also, the transfer medium position information output section 30 is provided as a mechanical or optical rotational position detection section which detects a rotational position of the secondary transfer roller 14, which corresponds to the transfer medium releasing position ϵ. In addition, the transfer medium position information output section is not to be limited to this, but a detector which detects an operation (changes in position) of the gripper 17 or a timer which measures the time from a position of the leading end of the transfer medium 20 at the secondary transfer nip portion 13*a* up to the transfer medium releasing position ϵ may also be used.

Further, the transfer medium transport roller operation control section 31 is constituted by driving members such as a known motor and a known link mechanism, for example, and controls movement of the transfer medium transport rollers 25*e* to the operation position and the retreat position. Then, the control section 28 controls the transfer medium transport roller operation control section 31 on the basis of the size of the transfer medium 20 from the transfer medium type information output section 29 and the position of the leading end of the transfer medium 20 passed through the secondary transfer nip portion 13*a* from the transfer medium position information output section 30. Hereinafter, one example of the control of the transfer medium transport roller operation control section 31 will be explained with respect to a case where transfer paper is used as the transfer medium 20. In this case, as the largest transfer paper which is used in the image forming apparatus 1 of this example, lengthwise A3-sized transfer paper is set to be transported.

First, with respect to the lengths of the sides of the above-mentioned virtual approximate triangle, the length of the side between the secondary transfer nip portion end position ζ and the transfer medium releasing position ϵ is set to be 85 mm, the length of the side between the transfer medium releasing position ϵ and the transfer medium transport section starting position η is set to be 76 mm, and the length between the secondary transfer nip portion end position ζ and the transfer medium transport section starting position η is set to be 150 mm. Therefore, the sum of two sides of the virtual approximate triangle is 161 mm, and the length of the remaining one side is 150 mm. In this case, a difference between the sum of the lengths of two sides and the length of the remaining one side is 11 mm. Also, both the inclination angles (acute angles) of the transfer medium guide direction of the guide surface $24a_1$ of the second air flow generation device 24 and the transfer medium transport direction of the transfer medium transport belt 25*a* with respect to the horizontal direction are the same and about 25°.

As shown in FIG. 11, when an image formation operation of the image forming apparatus 1 is not performed, the transfer medium transport roller operation control section 31 sets each transfer medium transport roller 25*e* to be located at an initial position of the operation position shown by a solid line or the retreat position shown by a dotted line. If consecutive image formation operations on two sheets of transfer papers are performed, the control section 28 determines whether or not the first sheet of transfer paper is located at a position of the secondary transfer nip portion, on the basis of the output information from the transfer medium position information output section 30. If the control section 28 determines that the first sheet of transfer paper is located at the position of the secondary transfer nip portion, the control section controls the transfer medium transport roller operation control section 31. Then, the transfer medium transport roller operation control section 31 sets each transfer medium transport roller 25*e* to be located at the operation position. Since the first sheet of transfer paper is located at the position of the secondary transfer nip portion, a toner image carried by the intermediate transfer belt 8 is transferred to the first sheet of transfer paper at the secondary transfer nip portion 13*a*.

If the leading end of the transfer medium 20 which has passed through the secondary transfer nip portion 13*a* reaches the transfer medium transport rollers 25*e* of the transfer medium transport section 25, as shown in FIG. 6A, the transfer medium 20 moves while being guided smoothly by the rotation of each transfer medium transport roller 25*e*. That is, even after the leading end 20*a* of the transfer medium 20 reaches the transfer medium transport section starting position η, while the transfer medium 20 is moved by the driving force of the secondary transfer roller 14, the back side of the transfer medium 20 is guided by the transfer medium transport rollers 25*e* of the transfer medium transport section 25, so that friction between the transfer medium 20 and the transfer medium transport section 25 is reduced. Then, if the leading end of the transfer medium reaches the transfer medium transport rollers 25*e* of the row furthest on the third air flow generation device 26 side, which is shown in FIG. 6B, the back end of the transfer medium 20 is located at the end position ζ of the secondary transfer nip portion 13*a*. Then, the control section 28 determines that the back end of the first sheet of transfer paper is located at the end position ζ of the secondary transfer nip portion 13*a*, on the basis of each output information from the transfer medium type information output section 29 and the transfer medium position information output section 30, and controls the transfer medium transport roller operation control section 31. Then, the transfer medium transport roller operation control section 31 sets each transfer medium transport rollers 25*e* to be located at the retreat position. That is, if the first sheet of transfer paper is located at a position other than the position of the secondary transfer nip portion, each transfer medium transport rollers 25*e* is set to be located at the retreat position. As a result of this, the first sheet of transfer paper is transported while being sucked to the transfer medium transport belt 25*a*, as shown in FIG. 6B.

Subsequently, the control section 28 determines whether or not the second sheet of transfer paper is located at the position of the secondary transfer nip portion, on the basis of the output information from the transfer medium position information output section 30. If the control section 28 determines that the second sheet of transfer paper is located at the position of the secondary transfer nip portion, the next toner image carried by the intermediate transfer belt 8 is transferred to the second sheet of transfer paper at the secondary transfer nip portion 13*a*. However, even if the control section 28 determines that the second sheet of transfer paper is located at the position of the secondary transfer nip portion, the control section does not immediately control the transfer medium transport roller operation control section 31. Therefore, each transfer medium transport roller 25*e* is maintained at the retreat position. If the control section 28 determines that the transportation of the first sheet of transfer paper by the transfer medium transport belt 25*a* has ended, on the basis of each output information from the transfer medium type information output section 29 and the transfer medium position information output section 30, the control section controls the transfer medium transport roller operation control section 31. Then, the transfer medium transport roller operation control section 31 sets each transfer medium transport roller 25*e* to be located at the operation position. Thereafter, the control section 28 controls the transfer medium transport roller operation control section 31 in the same way as the case of the operation of the image formation onto the first sheet of transfer paper, and also the transfer medium transport roller operation control section 31 controls the position of each transfer medium transport roller 25*e*. Then, if the control section 28 determines that the transportation of the second sheet of transfer paper by the transfer medium transport belt 25*a* has ended, on the basis of each output information from the transfer medium type information output section 29 and the transfer medium position information output section 30, the control section controls the transfer medium transport roller operation control section 31. Then, the transfer medium transport roller operation control section 31 sets each transfer medium transport roller 25*e* to be located at the above-mentioned initial position. In this way, the consecutive image formation operations on two sheets of transfer papers are performed. In addition, the case of image formation onto one sheet of transfer medium 20 or consecutive image formation onto three or more sheets of transfer mediums 20 is also the same.

The third air flow generation device 26 has a duct-shaped suction member 26*a* and an air flow generation section 26*b* such as a fan. The suction member 26*a* has a guide surface $\mathbf{26}a_1$ having a predetermined number of suction holes (not shown). The suction holes of the guide surface $\mathbf{26}a_1$ are disposed in the same way or approximately in the same way as the suction holes of the second air flow generation device 24 described above.

By the driving of the air flow generation section 26*b*, the suction member 26*a* sucks air in a direction indicated by an arrow through each suction hole of the guide surface $\mathbf{26}a_1$, thereby generating an air flow. Then, the transfer medium 20 transported from the transfer medium transport belt 25*a* is guided toward the fixing section 27 along the guide surface $\mathbf{26}a_1$ while the back surface thereof is sucked obliquely upward in a vertical direction by the suction member 26*a*.

The fixing section 27 has a fixing roller which includes a heating roller 27*a* and a pressure roller 27*b* which is brought into pressure-contact with the heating roller 27*a*. Then, the toner image of the transfer medium 20 is fixed by being heated and pressurized by the heating roller 27*a* and the pressure roller 27*b*. Thereafter, the transfer medium is discharged onto a discharge tray (not shown).

Since other configurations and other image formation operations of the image forming apparatus 1 of this example are similar to those of the same type of image forming apparatuses as in the related art, which use a liquid developer, the explanation thereof is omitted.

According to the image forming apparatus 1 and the image forming method of this example, the leading end portion 20*a* of the transfer medium 20 is gripped by the grippers 17, the toner image of the intermediate transfer belt 8 is transferred to the transfer medium 20 at the secondary transfer nip portion 13*a*, and after the secondary transfer, the gripping of the transfer medium 20 by the grippers 17 is released at the transfer medium releasing position ϵ, whereby the transfer medium 20 is released. Next, since the end position ζ of the secondary transfer nip portion 13*a*, the transfer medium releasing position ϵ, and the transfer medium transport section starting position η are disposed to form a virtual approximate triangle, the transfer medium 20 is moved to the second air flow generation device 24 with use of the middle portion thereof by the driving force of the secondary transfer roller, which is given at the secondary transfer nip portion 13*a*. Further, the transfer medium 20 is guided and moved to each transfer medium transport roller $\mathbf{24}a_3$ while the back surface thereof is sucked upward in a vertical direction to the suction member 24*a* of the second air flow generation device 24. Then, the leading end of the transfer medium 20 reaches the transfer medium transport section starting position η. In this case, when the distance between the end position ζ of the secondary transfer nip portion 13*a* and the transfer medium releasing position ϵ is L1 and the distance between the transfer medium releasing position ϵ and the transfer medium transport section starting position η is L2, the distance L between the end position ζ of the secondary transfer nip portion 13*a* and the transfer medium transport section starting position η has the relationship of L<L1+L2. Also, at this time, the transfer medium 20 is still moved by the driving force of the secondary transfer roller and the transfer medium transport rollers 25*e* are located at the operation position. Therefore, the transfer medium 20 is guided and moved to the transfer medium transport rollers 25*e* while the back surface side thereof is sucked upward in a vertical direction. In this manner, even after the leading end portion 20*a* of the transfer medium 20 reaches the transfer medium transport section starting position η, while the transfer medium 20 is moved by the driving force of the secondary transfer roller 14, the back side of the transfer medium 20 is guided by the transfer medium transport rollers 25*e* of the transfer medium transport section 25, so that friction between the transfer medium 20 and the transfer medium transport section 25 can be reduced. As a result of this, it becomes possible to suppress changes in the position of the transfer medium 20, whereby it becomes unstable. In particular, since friction between the transfer medium 20 and the transfer medium transport section 25 is reduced, by making two sides of the above-mentioned approximate triangle close to the remaining one side, it becomes possible to make the shape of the approximate triangle become a flatter triangular shape. As a result, it becomes possible to further suppress changes in position of the transfer medium 20. Therefore, the transfer medium 20 can be prevented from coming into contact with the intermediate transfer belt 8 and the first air flow generation device 23, which are disposed vertically below the movement pathway of the transfer medium 20, and also changes in nip portion width of the secondary transfer nip portion 13*a* can be suppressed. As a result, generation of displacement of the image can be suppressed. In this way, in the case of performing transfer in a state where the transfer medium 20 is gripped, even if the end position ζ of the secondary transfer nip portion 13*a*, the transfer medium releasing position ϵ, and the transfer medium transport section starting position η are disposed to form a virtual approximate triangle, an image forming apparatus 1 and an image forming method can be realized which allow an excellent image to be obtained.

In particular, since the portion of the transfer medium 20 gripped by the gripper 17 (the gripper receiving portion of the gripper support portion 18) is located in the concave portion 16 of the secondary transfer roller 14, the secondary transfer nip portion 13*a* can be stably formed. In this case, since the gripped portion of the transfer medium 20 is located in the concave portion 16 of the secondary transfer roller 14, the gripping trace curved to the transfer image surface side is formed at the leading end portion 20*a* of the transfer medium 20. Then, since the back surface of the transfer medium 20 is guided by the transfer medium transport rollers 25*e*, such a gripping trace is formed at the leading end portion 20*a* of the transfer medium 20, so that the transfer medium 20 can be prevented from being wrapped around the transfer medium transport roller, thereby penetrating between the adjacent transfer medium transport rollers 25*e*. As a result, even if the transfer medium 20 is guided by each transfer medium transport roller 25*e*, it is possible to move the transfer medium 20 smoothly.

Also, the position of the gripper 17 of the secondary transfer roller 14 and the position of each of the suction holes 25$a_2$ and 25$b_2$ of the transfer medium transport belt 25*a* and the suction member 25*b* are different from each other in the direction perpendicular or approximately perpendicular to the movement direction of the transfer medium 20. As a result of this, all the grippers 17 and all the suction holes 25$a_2$ and 25$b_2$ do not overlap with each other in the transfer medium movement direction. Therefore, as described above, even if the gripping traces are formed at the leading end portion 20*a* of the transfer medium 20, suction of the transfer medium 20 by the suction holes 25$a_2$ of the transfer medium transport belt 25*a* can be more effectively performed, and also the transfer medium 20 can be sucked and transported in a stable position.

Further, since the transfer medium transport rollers 25*e* are divided and disposed in the direction perpendicular or approximately perpendicular to the transfer medium movement direction, the transfer medium transport rollers 25*e* can be made small in size and light in weight and can also be easily rotated. Therefore, the guidance of the transfer medium 20 by the transfer medium transport rollers 25*e* can be more evenly performed, so that the position of the transfer medium 20 can be further stabilized.

Further, the respective grippers 17 are disposed at predetermined intervals in the direction perpendicular or approximately perpendicular to the transfer medium movement direction and also each of the transfer medium transport roller 24$a_3$ and 25*e* is disposed between the respective grippers 17. As a result of this, since each gripper 17 and each of the transfer medium transport roller 24$a_3$ and 25*e* do not overlap with each other in the transfer medium movement direction, as described above, even if the gripping trace is formed at the leading end portion 20*a* of the transfer medium 20, the gripping trace does not pass each of the transfer medium transport roller 24$a_3$ and 25*e*. Therefore, the guidance of the transfer medium 20 by each of the transfer medium transport roller 24$a_3$ and 25*e* is not affected by the gripping trace of the transfer medium 20, and the guidance of the transfer medium 20 by each of the transfer medium transport roller 24$a_3$ and 25*e* can be stably performed. As a result, the position of the transfer medium 20 can be stabilized at the time of the guidance of the transfer medium 20 by each of the transfer medium transport roller 24$a_3$ and 25*e*.

Further, in a case where disposition is made such that any of the respective transfer medium transport rollers 24$a_3$ and 25*e* overlap with any of the grippers 17 in the movement direction of the transfer medium 20, when the leading end portion 20*a* of the transfer medium 20 comes into contact with the transfer medium transport rollers 24$a_3$ and 25*e*, the leading end portion is led in a direction away from the guide surface 24$a_1$ and the facing guide surface 25$b_1$ by the respective transfer medium transport roller 24$a_3$ and 25*e*. Therefore, the leading end portion 20*a* of the transfer medium 20 can be prevented from being wrapped around the transfer medium transport rollers 24$a_3$ and 25*e*, thereby penetrating between the transfer medium transport rollers 24$a_3$ and 25*e* adjacent to each other in the transfer medium movement direction. As a result of this, the transfer medium 20 can be guided more smoothly along the guide surface 24$a_1$ and the facing guide surface 25$b_1$.

Further, a plurality of transfer medium transport rollers 25*e* are divided and disposed at predetermined intervals in the direction perpendicular or approximately perpendicular to the transfer medium movement direction, and also the transfer medium transport belt 25*a* having the suction holes 25$a_2$ is disposed between the transfer medium transport rollers 25*e*. Also, the transfer medium transport rollers 25*e* are disposed so as to be able to be moved between the operation position where the transfer medium 20 is transported and the retreat position where the transfer medium 20 is not transported. Then, by controlling the position of each transfer medium transport roller 25*e* by the transfer medium transport roller operation control section 31 which is controlled by the control section 28, while the transfer medium 20 is moved by the driving force of the secondary transfer roller 14, the transfer medium 20 is guided by each transfer medium transport roller 25*e*, and after the back end of the transfer medium 20 passes through the secondary transfer nip portion 13*a*, the transfer medium 20 is moved while being sucked upward in a vertical direction by the driving force of the transfer medium transport belt 25*a*. As a result of this, the movement of the transfer medium 20 can be performed more smoothly, so that the position of the transfer medium 20 can be further stabilized.

In addition, the transfer medium transport device and the image forming apparatus according to the invention are not to be limited to each example of the above-described embodiment. For example, the first to third air flow generation devices 23, 25, and 26 shown in FIG. 1 are not necessarily required, but may also be omitted.

Also, although the intermediate transfer belt 8 is used as the image carrier, an intermediate transfer drum may also be used and the photo conductor may also be used as the image carrier. In the case of using the photo conductor for the image carrier, it goes without saying that a toner image of the photo conductor is directly transferred to the transfer medium. Further, in the image forming apparatus of each example described above, a tandem type image forming apparatus is adopted. However, image forming apparatuses of other types are also acceptable and a monochromatic image forming apparatus is also acceptable. In short, the invention can be designed and modified in various aspects within the scope of the invention as defined in the appended claims.

The entire disclosure of Japanese Patent Application No: 2009-269940, filed Nov. 27, 2009 is expressly incorporated by reference herein.

What is claimed is:

1. An image forming apparatus comprising:

an image carrier that carries an image;

a transfer roller that has a gripping member for gripping or releasing a transfer medium, and that transfers the image carried by the image carrier to the transfer medium at a transfer nip portion that is formed by contacting with the image carrier; and a transfer medium transport section includes;

a transfer medium transport surface that sucks the transfer medium, on which the image is transferred at the transfer nip portion, upward in a vertical direction, and a contact member that is disposed on the transfer medium transport surface and contact with the transfer medium, thereby separating the transfer medium from the transfer medium transport surface, wherein a position where the transfer medium transport section starts to suck the transfer medium, a position where the gripping member releases the transfer medium, and a position where the transfer medium is separated from the image carrier are disposed at positions having the relationship of $L<L1+L2$, wherein L is the distance between the position where the transfer medium is separated from the image carrier and the position where the transfer medium transport section starts to suck the transfer medium, L1 is the distance between the position where the transfer medium is separated from the image carrier and the position where the gripping member releases the transfer medium, and L2 is the distance between the position where the gripping member releases the transfer medium and the position where the transfer medium transport section starts to suck the transfer medium.

2. The image forming apparatus according to claim 1, wherein the transfer roller has a concave portion in the circumferential surface thereof, and the gripping member is disposed in the concave portion.

3. The image forming apparatus according to claim 1, wherein the contact member is disposed in a plurality in the direction perpendicular or approximately perpendicular to a direction in which the transfer medium moves.

4. The image forming apparatus according to claim 3, wherein the transfer medium transport surface is a transfer medium transport belt having a suction hole that sucks the transfer medium by using an air flow, and the transfer medium transport belt is disposed between the contact members disposed in a plurality in the direction perpendicular or approximately perpendicular to the direction in which the transfer medium moves.

5. The image forming apparatus according to claim 4, wherein a position where the gripping member is disposed and a position where the suction hole of the transfer medium transport belt is disposed are different from each other in the direction perpendicular to the direction in which the transfer medium moves.

6. The image forming apparatus according to claim 1, further comprising:

a driving member that drives the contact member from a position where the contact member contact with the transfer medium to a position where the contact member is separated from the transfer medium; and a controller that controls a movement of the contact member by the driving member.

7. The image forming apparatus according to claim 1, wherein the contact member is a roller member.

8. An image forming method comprising:

gripping a transfer medium by a gripping member disposed in a circumferential surface of a transfer roller;

transporting the transfer medium gripped by the gripping member to a transfer nip portion which is formed by an image carrier and the transfer roller, thereby transferring an image carried by the image carrier to the transfer medium;

releasing the transfer medium from the gripping member by moving the gripping member after the transfer of the image to the transfer medium; and transporting the released transfer medium while sucking the transfer medium at a transfer medium transport surface of a transfer medium transport section; wherein, a position where the transfer medium starts to be sucked, and that has the relationship of $L<L1+L2$ and also separating the transfer medium from the transfer medium transport surface by a contact member, wherein a position where the transfer medium transport section starts to suck the transfer medium, a position where the gripping member releases the transfer medium, and a position where the transfer medium is separated from the image carrier are disposed at positions having the relationship of $L<L1+L2$, wherein L is the distance between the position where the transfer medium is separated from the image carrier and the position where the transfer medium transport section starts to suck the transfer medium, L1 is the distance between the position where the transfer medium is separated from the image carrier and the position where the gripping member releases the transfer medium, and L2 is the distance between the position where the gripping member releases the transfer medium and the position where the transfer medium transport section starts to suck the transfer medium.

* * * * *